US012241460B2

(12) United States Patent
Jeon et al.

(10) Patent No.: US 12,241,460 B2
(45) Date of Patent: Mar. 4, 2025

(54) LINEAR COMPRESSOR

(71) Applicant: LG Electronics Inc., Seoul (KR)

(72) Inventors: Wooju Jeon, Seoul (KR); Donghan Kim, Seoul (KR); Sangik Son, Seoul (KR); Jaehyeok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 42 days.

(21) Appl. No.: 18/011,432

(22) PCT Filed: Dec. 13, 2021

(86) PCT No.: PCT/KR2021/018883
§ 371 (c)(1),
(2) Date: Dec. 19, 2022

(87) PCT Pub. No.: WO2022/145805
PCT Pub. Date: Jul. 7, 2022

(65) Prior Publication Data

US 2023/0243345 A1 Aug. 3, 2023

(30) Foreign Application Priority Data

Dec. 30, 2020 (KR) ..... 10-2020-0188307

(51) Int. Cl.
*F04B 39/00* (2006.01)
*F04B 35/04* (2006.01)
(Continued)

(52) U.S. Cl.
CPC ..... *F04B 39/0022* (2013.01); *F04B 39/0016* (2013.01); *F04B 39/0061* (2013.01);
(Continued)

(58) Field of Classification Search
CPC ..... F04B 39/0022; F04B 39/0016; F04B 39/0055; F04B 39/0061; F04B 35/045;
(Continued)

(56) References Cited

U.S. PATENT DOCUMENTS 5,722,817 A * 3/1998 Park ..... F04B 39/0055 181/403
9,534,591 B2 1/2017 Roettger et al.
(Continued)

FOREIGN PATENT DOCUMENTS

JP H09287575 11/1997
KR 20070106998 11/2007
(Continued)

*Primary Examiner* — David N Brandt
(74) *Attorney, Agent, or Firm* — Fish & Richardson P.C.

(57) ABSTRACT

A linear compressor is provided. The linear compressor includes a cylinder, a piston configured to reciprocate inside the cylinder, the piston including a head portion and a sliding portion extending rearward from a radially outer edge of the head portion, a supporter including a plate disposed at a rear of the piston, an elastic body disposed in the piston, the elastic body including an outer side coupled to an inner circumferential surface of the piston, and a rod configured to extend axially, the rod including one side coupled to a radially central area of the elastic body and other side connected to a radially central area of the plate.

10 Claims, 13 Drawing Sheets

(51) Int. Cl.
*F04B 53/00* (2006.01)
*F04B 53/14* (2006.01)

(52) U.S. Cl.
CPC ..... *F04B 35/045* (2013.01); *F04B 39/0044* (2013.01); *F04B 53/003* (2013.01); *F04B 53/004* (2013.01); *F04B 53/145* (2013.01); *F04B 53/147* (2013.01)

(58) Field of Classification Search
CPC .. F04B 39/0044; F04B 53/003; F04B 53/004; F04B 53/145; F04B 53/147; F04B 39/0005; F04B 39/1073; F04B 39/123
See application file for complete search history.

(56) References Cited

U.S. PATENT DOCUMENTS

| | | | | |
|---|---|---|---|---|
| 10,746,164 | B2 * | 8/2020 | Hahn | F16J 1/22 |
| 2002/0043153 | A1 | 4/2002 | An et al. | |
| 2008/0118375 | A1 * | 5/2008 | Muth | F04B 35/04 417/363 |
| 2015/0110657 | A1 * | 4/2015 | Spiegl | F04B 49/16 417/552 |

FOREIGN PATENT DOCUMENTS

| | | |
|---|---|---|
| KR | 101167736 | 7/2012 |
| KR | 20190096502 | 8/2019 |

* cited by examiner

LINEAR COMPRESSOR

CROSS-REFERENCE TO RELATED APPLICATIONS

This application is a National Stage application under 35 U.S.C. § 371 of International Application No. PCT/KR2021/018883, filed on Dec. 13, 2021, which claims the benefit of Korean Patent Application No. 10-2020-0188307, filed on Dec. 30, 2020. The disclosures of the prior applications are incorporated by reference in their entirety.

TECHNICAL FIELD

The present disclosure relates to a linear compressor. More specifically, the present disclosure relates to a linear compressor for compressing a refrigerant by a linear reciprocating motion of a piston.

BACKGROUND ART

In general, a linear compressor refers to a device that is configured to receive power from a power generator such as a motor or a turbine and compress a working fluid such as air or refrigerant. More specifically, the linear compressors are widely used in the whole industry or home appliances, such as for a steam compression refrigeration cycle (hereinafter, referred to as "refrigeration cycle").

The compressors may be classified into a reciprocating compressor, a rotary compressor, and a scroll compressor according to a method of compressing the refrigerant.

The reciprocating compressor uses a method in which a compression space is formed between a piston and a cylinder, and the piston linearly reciprocates to compress a fluid. The rotary compressor uses a method of compressing a fluid by a roller that eccentrically rotates inside a cylinder. The scroll compressor uses a method of compressing a fluid by engaging and rotating a pair of spiral scrolls.

Recently, among the reciprocating compressors, the use of linear compressors that uses a linear reciprocating motion without using a crank shaft is gradually increasing. The linear compressor has advantages in that it has less mechanical loss resulting from switching a rotary motion to the linear reciprocating motion and thus can improve the efficiency, and has a relatively simple structure.

The linear compressor is configured such that a cylinder is positioned in a casing forming a sealed space to form a compression chamber, and a piston covering the compression chamber reciprocates in the cylinder. The linear compressor repeats a process in which a fluid in the sealed space is sucked into the compression chamber while the piston is positioned at a bottom dead center (BDC), and the fluid of the compression chamber is compressed and discharged while the piston is positioned at a top dead center (TDC).

A compression unit and a drive unit (motor) are installed inside the linear compressor. The compression unit performs a process of compressing and discharging a refrigerant while performing a resonant motion by a resonant spring through a movement generated in the drive unit.

The piston of the linear compressor repeatedly performs a series of processes of sucking the refrigerant into the casing through an intake pipe while reciprocating at high speed inside the cylinder by the resonant spring, and then discharging the refrigerant from a compression space through a forward movement of the piston to move it to a condenser through a discharge pipe.

The piston reciprocates axially while floating inside the cylinder through a gas spring. In this instance, if an axis of the piston is misaligned due to tilting and/or eccentricity of the piston, a friction occurs between inner circumferential surfaces of the piston and the cylinder. Further, since an axis of a magnet frame that reciprocates integrally with the piston is also misaligned, it becomes difficult to keep a gap of the motor constant. These problems wear and damage the components, and reduce the efficiency of the linear compressor.

The related art linear compressor supported the piston using a flexible rod made of an elastic material, in order to solve the axis alignment problem described above. Through this, since the piston can be flexibly supported from a supporter, the piston can float while maintaining a constant distance from the inner circumferential surface of the cylinder even if the alignment of the supporter is misaligned.

The linear compressor is disclosed in U.S. Pat. No. 9,534,591 B2 (hereinafter, 'prior art 1').

In order to solve the axis alignment problem described above, a head portion and a sliding portion of the piston were combined using a universal joint. Through this, since the head portion and the sliding portion of the piston can move separately, the head portion can float while maintaining a constant distance from the inner circumferential surface of the cylinder even if the alignment of the piston is misaligned.

The linear compressor is disclosed in U.S. Pat. No. 10,746,164 B2 (hereinafter, 'prior art 2').

However, in the prior art 1 and the prior art 2, even if the axis alignment of the piston is maintained, it may be difficult to maintain axis alignment of other mover such as the supporter and/or the magnet frame connected to the piston. Hence, since a gap between a stator and a magnet cannot be kept constant, there were problems in that the efficiency of the linear compressor was reduced, the components were worn and damaged, and a noise was generated.

In the flexible rod disclosed in the prior art 1, it was difficult to design a rotation point because elastic deformation occurs in the entire flexible rod when the linear compressor operates. Since the universal joint disclosed in the prior art 2 uses a larger number of components, the universal joint had a lot of influence on the layout of surrounding components when changing the center of rotation of the piston, making it difficult to change the center of rotation. Hence, there is a limit to controlling a stable behavior of the piston.

In the prior art 2, since two members connected by the universal joint move relative to each other, friction and/or wear of a contact area of the two members may occur. There were problems in that the friction and/or wear caused a gap between the two members connected by the universal joint and increased a noise.

Since a separate lubricant is required to reduce the friction and/or wear described above, there was a problem in that the manufacturing cost increased.

DISCLOSURE

Technical Problem

An object of the present disclosure is to prevent a damage of components and noise generation and improve efficiency of a linear compressor by aligning an axis of a piston and at the same time efficiently aligning an axis of another mover such as a supporter and/or a magnet frame to reduce a contact and/or wear between the components.

Another object of the present disclosure is to provide a linear compressor capable of preventing tilting and/or eccentricity of a piston through a simple structure and easily controlling a behavior of the piston.

Another object of the present disclosure is to provide a linear compressor capable of removing a gap between two members connected to each other by a joint and reducing a noise by allowing a piston to be supported by a rigid joint.

Another object of the present disclosure is to provide a linear compressor capable of reducing the manufacturing cost using a rigid joint not requiring a lubricant.

Technical Solution

To achieve the above-described and other objects, in one aspect of the present disclosure, there is provided a linear compressor comprising a cylinder; a piston configured to reciprocate inside the cylinder, the piston comprising a sliding portion and a head portion disposed at a front of the sliding portion; a supporter comprising a plate disposed at a rear of the piston; an elastic body disposed in the piston, the elastic body comprising an outer side coupled to an inner circumferential surface of the piston; and a rod configured to extend axially, the rod comprising one side coupled to a radially central area of the elastic body and other side connected to a radially central area of the plate.

Through this, the present disclosure can align an axis of the piston, and at the same time efficiently align an axis of another mover such as the supporter and/or a magnet frame. Hence, the present disclosure can prevent a damage of components and noise generation and improve efficiency of the linear compressor by reducing a contact and/or wear between the components.

The present disclosure can also prevent tilting and/or eccentricity of the piston through a simple structure and easily control a behavior of the piston.

The present disclosure can also remove a contact and/or wear, remove a gap between two members connected to each other by a joint, and reduce a noise by allowing the piston to be supported by a rigid joint.

The present disclosure can also reduce the manufacturing cost using a rigid joint not requiring a lubricant.

The elastic body may extend radially outward. The elastic body may comprise a plurality of first flow holes disposed radially about an axis.

The head portion may comprise an intake port into which a refrigerant flows. The intake port may be formed at a position axially overlapping at least a part of the plurality of first flow holes. When viewed axially, a sum of areas of the plurality of first flow holes may be greater than a sum of area of the intake port.

The linear compressor may further comprise a muffler unit inserted into the piston at the rear of the piston, and the muffler unit may comprise an internal flow path extending axially. When viewed axially, a sum of areas of the plurality of first flow holes may be greater than an area of a cross-section of a narrowest portion of the internal flow path.

The elastic body may comprise a plurality of elastic units extending radially outward. An outer side of each of the plurality of elastic units may be coupled to an inner circumferential surface of the sliding portion.

The sliding portion may comprise a groove formed on an inner circumferential surface of the sliding portion, and the elastic body may be coupled to the groove.

One of an outer circumferential surface of the elastic body and an inner circumferential surface of the sliding portion may comprise a first coupling groove, and the other may comprise a coupling protrusion coupled to the first coupling groove.

The one side of the rod may be formed of a male screw. A coupling hole formed of a female screw may be comprised in the radially central area of the elastic body, and the coupling hole may be screw-coupled to the one side of the rod.

An outer circumferential surface of the elastic body may be formed of a male screw. A part of an inner circumferential surface of the sliding portion to which the elastic body is coupled may be formed of a female screw. The elastic body may be screw-coupled to the inner circumferential surface of the sliding portion.

The one side of the rod may be formed of a male screw. A coupling hole formed of a female screw may be comprised in the radially central area of the elastic body, and the coupling hole may be screw-coupled to the one side of the rod. An outer circumferential surface of the elastic body may be formed of a male screw. A part of an inner circumferential surface of the sliding portion to which the elastic body is coupled may be formed of a female screw. The elastic body may be screw-coupled to the inner circumferential surface of the sliding portion. A rotation direction in which the elastic body is coupled to the rod and a rotation direction in which the sliding portion is coupled to the elastic body may be the same.

The rod may be formed of a rigid material.

The plate may comprise a second flow hole formed on a radially outer side of the rod. When viewed axially, the second flow hole may be formed in an inner area of an inner circumferential surface of the sliding portion.

The plate may comprise a third flow hole formed in a radially outer portion. The supporter may comprise a body portion coupled to an outer side of the plate and a spring seat portion extending to a radially outer side of the body portion. The body portion may comprise a portion protruding to a front of the plate. A radius of an inner circumferential surface of a front end of the body portion may be less than a radius of the plate.

The linear compressor may further comprise a muffler unit inserted into the piston at the rear of the piston, and the muffler unit may be disposed at a front or a rear of the elastic body.

The linear compressor may further comprise a muffler unit disposed in the piston, and the muffler unit may comprise an internal flow path extending axially and a noise space formed on a radially outer side of a part of the internal flow path. The elastic body may be disposed at a position where the noise space is formed.

To achieve the above-described and other objects, in another aspect of the present disclosure, there is provided a linear compressor comprising a cylinder; a piston configured to reciprocate inside the cylinder, the piston comprising a sliding portion and an elastic portion disposed at a front of the sliding portion; a supporter comprising a plate disposed at a rear of the piston; and a rod configured to extend axially, the rod comprising one side coupled to a radially central area of the elastic portion and other side connected to a radially central area of the plate, wherein the elastic portion comprises a plurality of fourth flow holes disposed radially about an axis.

The linear compressor may further comprise an intake valve coupled to a front of the elastic portion, and the intake valve may be configured to cover fronts of the plurality of fourth flow holes.

Each of the plurality of fourth flow holes may be formed in a spiral shape.

The linear compressor may further comprise an intake valve coupled to a front of the elastic portion, and a coupling member configured to couple the intake valve and the piston to the one side of the rod. The coupling member may axially pass through a radially central area of the intake valve and the radially central area of the elastic portion and may be coupled to the one side of the rod.

The coupling member may be formed of a male screw. The rod may comprise a second coupling groove formed of a female screw on the one side of the rod. The coupling member may be screw-coupled to the second coupling groove.

Advantageous Effects

The present disclosure can align an axis of a piston, and at the same time efficiently align an axis of another mover such as a supporter and/or a magnet frame. Hence, the present disclosure can prevent a damage of components and noise generation and improve efficiency of a linear compressor by reducing a contact and/or wear between the components.

The present disclosure can also prevent tilting and/or eccentricity of the piston through a simple structure and easily control a behavior of the piston.

The present disclosure can also remove a contact and/or wear, remove a gap between two members connected to each other by a joint, and reduce a noise by allowing the piston to be supported by a rigid joint.

The present disclosure can also reduce the manufacturing cost using a rigid joint not requiring a lubricant.

BEST MODE

Reference will now be made in detail to embodiments of the present disclosure, examples of which are illustrated in the accompanying drawings. Wherever possible, the same reference numbers will be used throughout the drawings to refer to the same or like parts.

It should be understood that when a component is described as being "connected to" or "coupled to" other component, it may be directly connected or coupled to the other component or intervening component(s) may be present.

It will be noted that a detailed description of known arts will be omitted if it is determined that the detailed description of the known arts obscure embodiments of the present disclosure. The accompanying drawings are used to help easily understand various technical features and it should be understood that embodiments presented herein are not limited by the accompanying drawings. As such, the present disclosure should be understood to extend to any alterations, equivalents and substitutes in addition to those which are particularly set out in the accompanying drawings.

In addition, a term of "disclosure" may be replaced by document, specification, description, etc.

Figure 1:
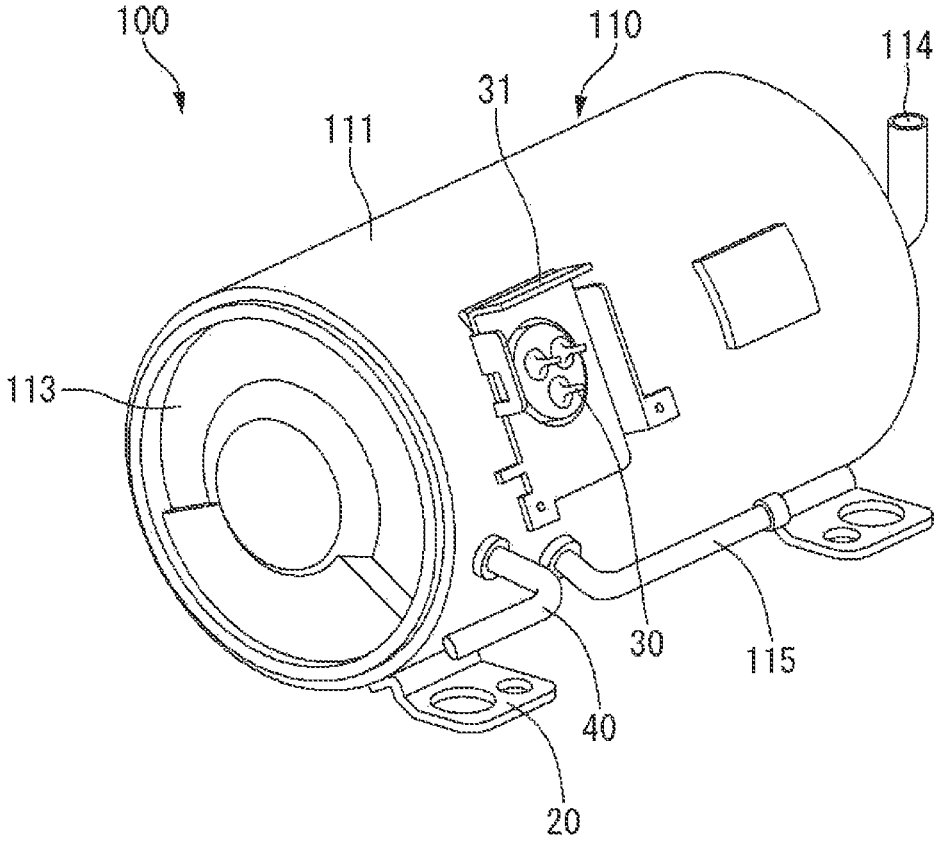
FIG. 1 is a perspective view of a linear compressor according to a first embodiment of the present disclosure.

FIG. 1 is a perspective view of a linear compressor 100 according to a first embodiment of the present disclosure.

Referring to FIG. 1, a linear compressor 100 according to an embodiment of the present disclosure may include a shell 111 and shell covers 112 and 113 coupled to the shell 111. In a broad sense, the shell covers 112 and 113 can be understood as one configuration of the shell 111.

Legs 20 may be coupled to a lower side of the shell 111. The legs 20 may be coupled to a base of a product on which the linear compressor 100 is mounted. For example, the product may include a refrigerator, and the base may include a machine room base of the refrigerator. As another example, the product may include an outdoor unit of an air conditioner, and the base may include a base of the outdoor unit.

The shell 111 may have a substantially cylindrical shape and may be disposed to lie in a horizontal direction or an axial direction. FIG. 1 illustrates that the shell 111 is extended in the horizontal direction and has a slightly low height in a radial direction, by way of example. That is, since the linear compressor 100 can have a low height, there is an advantage in that a height of the machine room can decrease when the linear compressor 100 is installed in, for example, the machine room base of the refrigerator.

A longitudinal central axis of the shell 111 coincides with a central axis of a main body of the linear compressor 100 to be described below, and the central axis of the main body of the linear compressor 100 coincides with a central axis of a cylinder 140 and a piston 150 that constitute the main body of the linear compressor 100.

A terminal 30 may be installed on an outer surface of the shell 111. The terminal 30 may transmit external electric power to a drive unit 130 of the linear compressor 100. More specifically, the terminal 30 may be connected to a lead line of a coil 132*b*.

A bracket 31 may be installed on the outside of the terminal 30. The bracket 31 may include a plurality of brackets surrounding the terminal 30. The bracket 31 may perform a function of protecting the terminal 30 from an external impact, etc.

Both sides of the shell 111 may be opened. The shell covers 112 and 113 may be coupled to both sides of the opened shell 111. More specifically, the shell covers 112 and 113 may include a first shell cover 112 coupled to one opened side of the shell 111 and a second shell cover 113 coupled to the other opened side of the shell 111. An inner space of the shell 111 may be sealed by the shell covers 112 and 113.

FIG. 1 illustrates that the first shell cover 112 is positioned on the right side of the linear compressor 100, and the second shell cover 113 is positioned on the left side of the linear compressor 100, by way of example. In other words, the first and second shell covers 112 and 113 may be disposed to face each other. It can be understood that the first shell cover 112 is positioned on an intake side of a refrigerant, and the second shell cover 113 is positioned on a discharge side of the refrigerant.

The linear compressor 100 may include a plurality of pipes 114, 115, and 40 that are included in the shell 111 or the shell covers 112 and 113 and can suck, discharge, or inject the refrigerant.

The plurality of pipes 114, 115, and 40 may include an intake pipe 114 that allows the refrigerant to be sucked into the linear compressor 100, a discharge pipe 115 that allows the compressed refrigerant to be discharged from the linear compressor 100, and a supplementary pipe 40 for supplementing the refrigerant in the linear compressor 100.

For example, the intake pipe 114 may be coupled to the first shell cover 112. The refrigerant may be sucked into the linear compressor 100 along the axial direction through the intake pipe 114.

The discharge pipe 115 may be coupled to an outer circumferential surface of the shell 111. The refrigerant sucked through the intake pipe 114 may be compressed while flowing in the axial direction. The compressed refrigerant may be discharged through the discharge pipe 115. The discharge pipe 115 may be disposed closer to the second shell cover 113 than to the first shell cover 112.

The supplementary pipe 40 may be coupled to the outer circumferential surface of the shell 111. A worker may inject the refrigerant into the linear compressor 100 through the supplementary pipe 40.

The supplementary pipe 40 may be coupled to the shell 111 at a different height from the discharge pipe 115 in order to prevent interference with the discharge pipe 115. Herein, the height may be understood as a distance measured from the leg 20 in a vertical direction. Because the discharge pipe 115 and the supplementary pipe 40 are coupled to the outer circumferential surface of the shell 111 at different heights, the work convenience can be attained.

On an inner circumferential surface of the shell 111 corresponding to a location at which the supplementary pipe 40 is coupled, at least a portion of the second shell cover 113 may be positioned adjacently. In other words, at least a portion of the second shell cover 113 may act as a resistance of the refrigerant injected through the supplementary pipe 40.

Thus, with respect to a flow path of the refrigerant, a size of the flow path of the refrigerant introduced through the supplementary pipe 40 is configured to decrease by the second shell cover 113 while the refrigerant enters into the inner space of the shell 111, and to increase again while the refrigerant passes through the second shell cover 113. In this process, a pressure of the refrigerant may be reduced to vaporize the refrigerant, and an oil contained in the refrigerant may be separated. Thus, while the refrigerant, from which the oil is separated, is introduced into the piston 150, a compression performance of the refrigerant can be improved. The oil may be understood as a working oil present in a cooling system.

Figure 2:
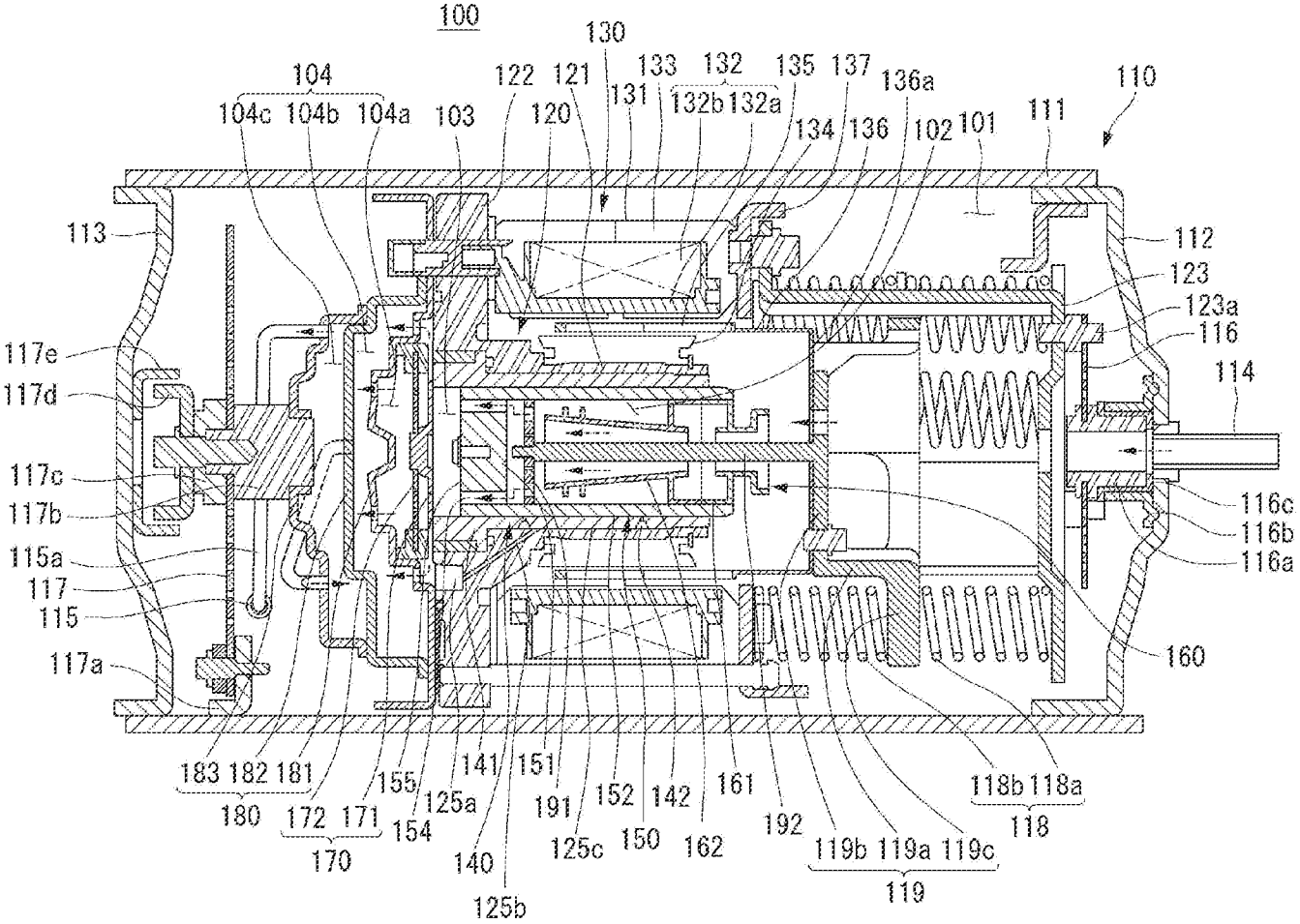
FIG. 2 is a cross-sectional view of a linear compressor according to a first embodiment of the present disclosure.
Figure 3:
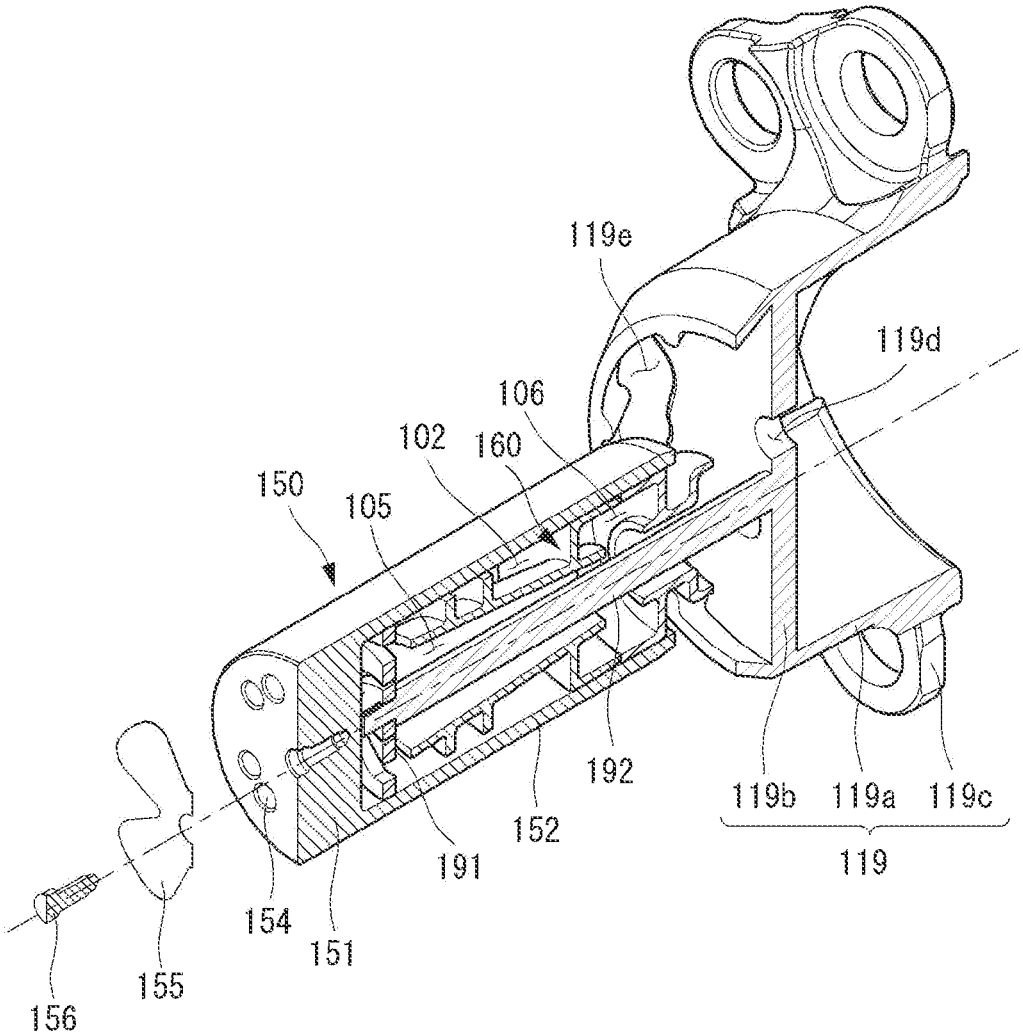
FIG. 3 is a cross-sectional perspective view of partial configuration of a linear compressor according to a first embodiment of the present disclosure.
Figure 4:
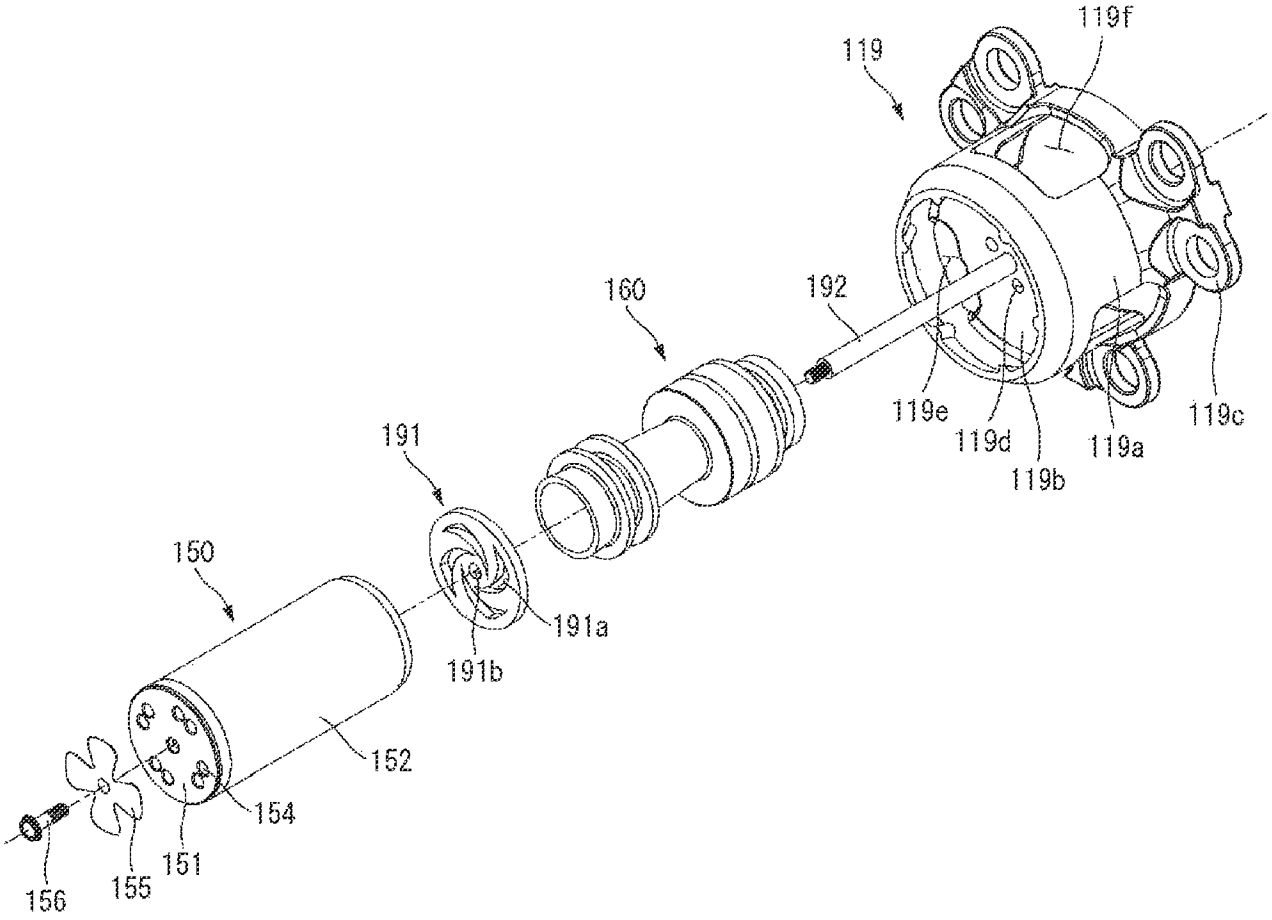
FIG. 4 is an exploded perspective view of partial configuration of a linear compressor according to a first embodiment of the present disclosure.
Figure 5:
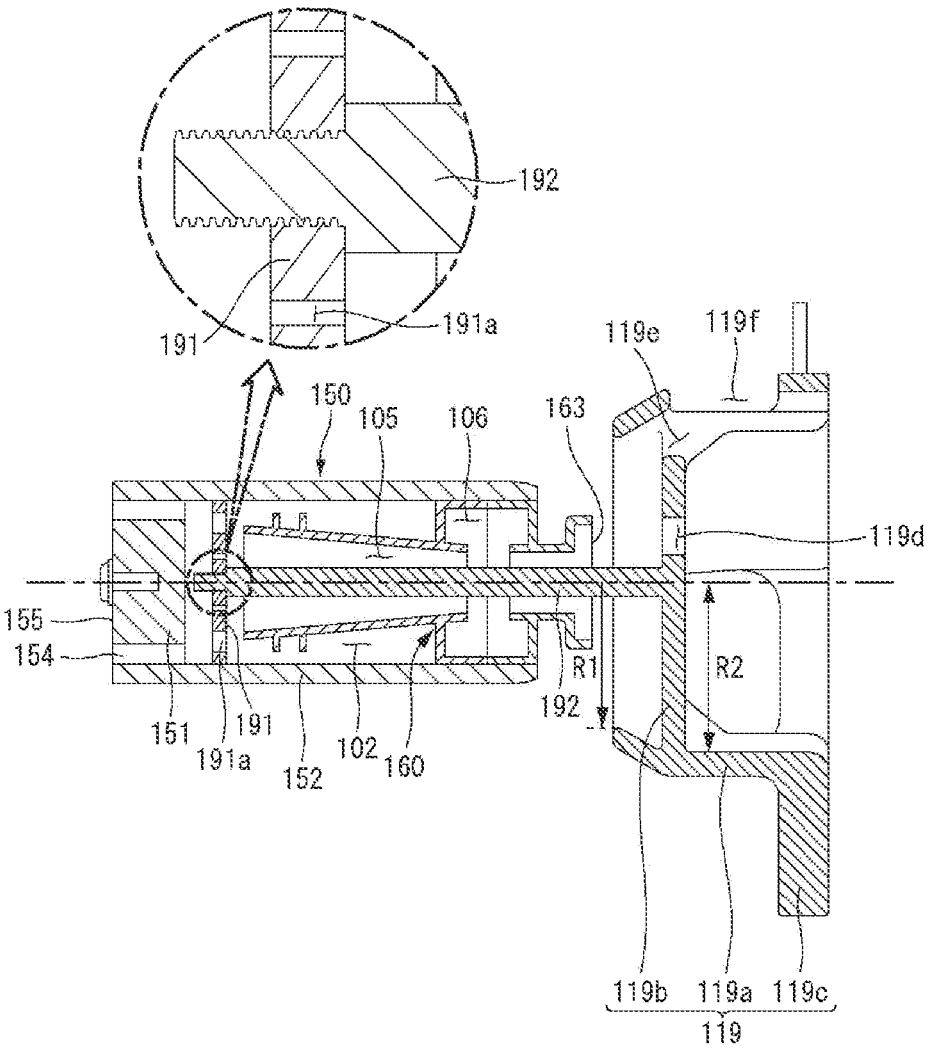
FIG. 5 is a cross-sectional view of partial configuration of a linear compressor according to a first embodiment of the present disclosure.
Figure 6:
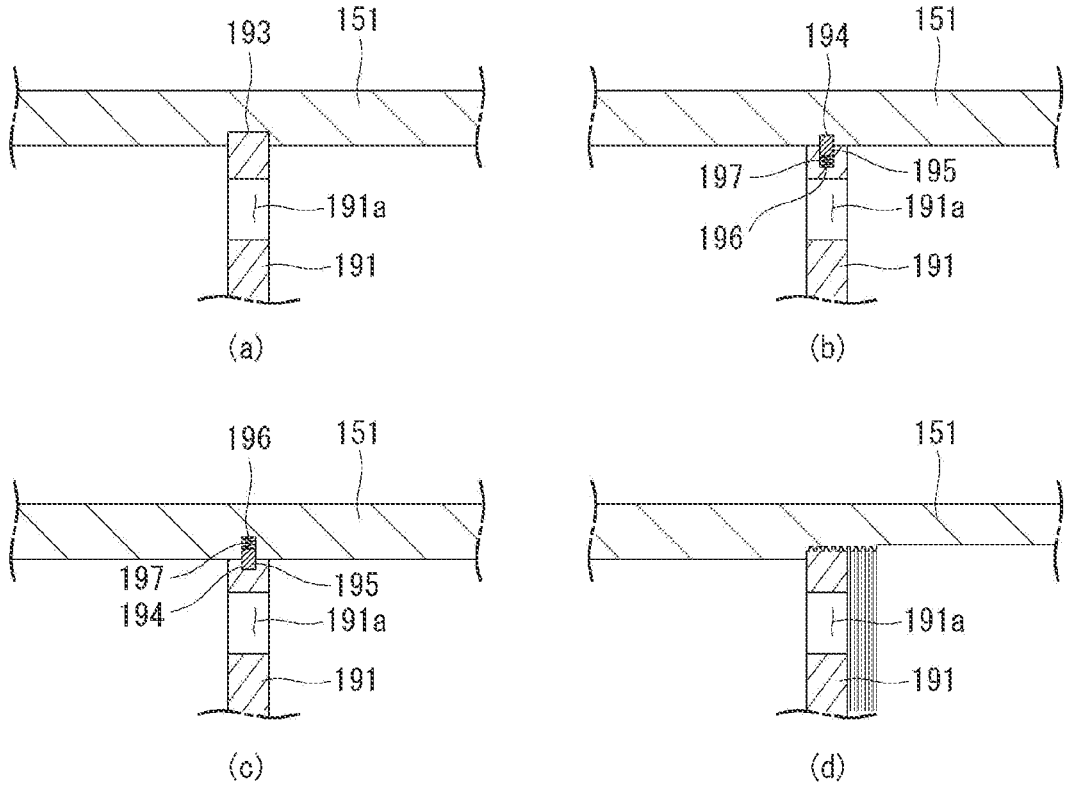
FIG. 6 is a perspective view illustrating one side of a rod and an elastic body of a linear compressor according to a first embodiment of the present disclosure.
Figure 7:
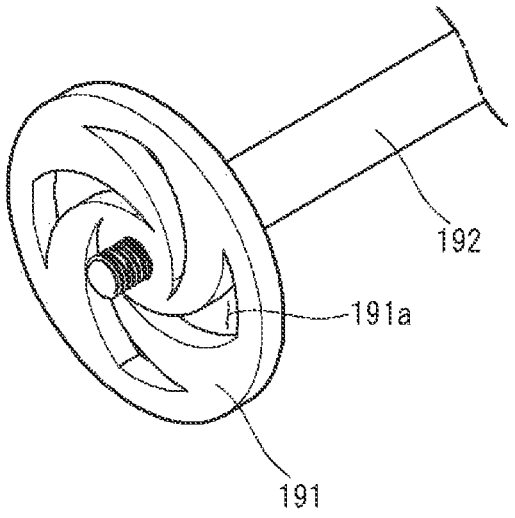
FIG. 7 is a cross-sectional view illustrating a coupling method of an elastic body and a sliding portion in a linear compressor according to a first embodiment of the present disclosure.

FIG. 2 is a cross-sectional view of the linear compressor 100 according to the first embodiment of the present disclosure. FIG. 3 is a cross-sectional perspective view of partial configuration of the linear compressor 100 according to the first embodiment of the present disclosure. FIG. 4 is an exploded perspective view of partial configuration of the linear compressor 100 according to the first embodiment of the present disclosure. FIG. 5 is a cross-sectional view of partial configuration of the linear compressor 100 according to the first embodiment of the present disclosure. FIG. 6 is a perspective view illustrating one side of a rod 192 and an elastic body 191 of the linear compressor 100 according to the first embodiment of the present disclosure. FIG. 7 is a cross-sectional view illustrating a coupling method of the elastic body 191 and a sliding portion 152 in the linear compressor 100 according to the first embodiment of the present disclosure.

Hereinafter, the linear compressor according to the present disclosure will be described taking, as an example, a linear compressor that sucks and compresses a fluid while a piston linearly reciprocates, and discharges the compressed fluid.

The linear compressor 100 according to the first embodiment of the present disclosure may include the cylinder 140, the piston 150, a muffler unit 160, a supporter 119, the elastic body 191, and the rod 192, but can be implemented except some of these components and does not exclude additional components.

It can be understood that detailed configuration of a linear compressor according to the present disclosure illustrated in FIGS. 8 to 15, in which the description is omitted later, is the same as detailed configuration of the linear compressor 100 according to the first embodiment of the present disclosure illustrated in FIGS. 2 to 7.

The linear compressor 100 may be a component of a refrigeration cycle, and a fluid compressed in the linear compressor 100 may be a refrigerant circulating the refrigeration cycle. The refrigeration cycle may include a condenser, an expander, an evaporator, etc., in addition to the linear compressor 100. The linear compressor 100 may be used as a component of the cooling system of the refrigerator, but is not limited thereto. The linear compressor 100 can be widely used in the whole industry.

Referring to FIG. 2, the linear compressor 100 may include a casing 110 and a main body received in the casing 110. The main body of the linear compressor 100 may include a frame 120, the cylinder 140 fixed to the frame 120, the piston 150 that linearly reciprocates inside the cylinder 140, the drive unit 130 that is fixed to the frame 120 and gives a driving force to the piston 150, and the like. Here, the cylinder 140 and the piston 150 may be referred to as compression units 140 and 150.

The linear compressor 100 may include a bearing means for reducing a friction between the cylinder 140 and the piston 150. The bearing means may be an oil bearing or a gas bearing. Alternatively, a mechanical bearing may be used as the bearing means.

The main body of the linear compressor 100 may be elastically supported by support springs 116 and 117 installed at both ends in the casing 110. The support springs 116 and 117 may include a first support spring 116 for supporting the rear of the main body and a second support spring 117 for supporting a front of the main body. The support springs 116 and 117 may include a leaf spring. The support springs 116 and 117 can absorb vibrations and impacts generated by a reciprocating motion of the piston 150 while supporting the internal components of the main body of the linear compressor 100.

The casing 110 may define a sealed space. The sealed space may include an accommodation space 101 in which the sucked refrigerant is received, an intake space 102 which is filled with the refrigerant before the compression, a compression space 103 in which the refrigerant is compressed, and a discharge space 104 which is filled with the compressed refrigerant.

The refrigerant sucked from the intake pipe 114 connected to the rear side of the casing 110 may be filled in the accommodation space 101, and the refrigerant in the intake space 102 communicating with the accommodation space 101 may be compressed in the compression space 103, discharged into the discharge space 104, and discharged to the outside through the discharge pipe 115 connected to the front side of the casing 110.

The casing 110 may include the shell 111 formed in a substantially cylindrical shape that is open at both ends and is long in a transverse direction, the first shell cover 112 coupled to the rear side of the shell 111, and the second shell cover 113 coupled to the front side of the shell 111. Here, it can be understood that the front side is the left side of the figure and is a direction in which the compressed refrigerant is discharged, and the rear side is the right side of the figure and is a direction in which the refrigerant is introduced. Further, the first shell cover 112 and the second shell cover 113 may be formed as one body with the shell 11.

The casing 110 may be formed of a thermally conductive material. Hence, heat generated in the inner space of the casing 110 can be quickly dissipated to the outside.

The first shell cover 112 may be coupled to the shell 111 in order to seal the rear of the shell 111, and the intake pipe 114 may be inserted and coupled to the center of the first shell cover 112.

The rear of the main body of the linear compressor 100 may be elastically supported by the first support spring 116 in the radial direction of the first shell cover 112.

The first support spring 116 may include a circular leaf spring. A back cover 123 may be axially elastically supported by a back cover support ember 123*a* formed at an edge of the first support spring 116. An opened center portion of the first support spring 116 may be coupled to an intake guide 116*a* and axially elastically supported.

The intake guide 116*a* may have a through passage formed therein. The intake guide 116*a* may be formed in a cylindrical shape. A front outer circumferential surface of the intake guide 116*a* may be coupled to a central opening of the first support spring 116, and a rear end of the intake guide 116*a* may be supported by the first shell cover 112. In this instance, a separate intake support member 116*b* may be interposed between the intake guide 116*a* and an inner surface of the first shell cover 112.

A rear side of the intake guide 116*a* may communicate with the intake pipe 114, and the refrigerant sucked through the intake pipe 114 may pass through the intake guide 116*a* and may be smoothly introduced into a muffler unit 160 to be described below.

A damping member 116*c* may be disposed between the intake guide 116*a* and the intake support member 116*b*. The damping member 116*c* may be formed of a rubber material or the like. Hence, a vibration that may occur in the process of sucking the refrigerant through the intake pipe 114 can be prevented from being transmitted to the first shell cover 112.

The second shell cover 113 may be coupled to the shell 111 to seal the front side of the shell 111, and the discharge pipe 115 may be inserted and coupled through a loop pipe 115*a*. The refrigerant discharged from the compression space 103 may pass through a discharge cover assembly 180 and then may be discharged into the refrigeration cycle through the loop pipe 115*a* and the discharge pipe 115.

A front side of the main body of the linear compressor 100 may be elastically supported by the second support spring 117 in the radial direction of the shell 111 or the second shell cover 113.

The second support spring 117 may include a circular leaf spring. An opened center portion of the second support spring 117 may be supported by a first support guide 117*b* in a rearward direction with respect to the discharge cover assembly 180. An edge of the second support spring 117 may be supported by a support bracket 117*a* in a forward direction with respect to the inner surface of the shell 111 or the inner circumferential surface of the shell 111 adjacent to the second shell cover 113.

Unlike the configuration illustrated in FIG. 2, the edge of the second support spring 117 may be supported in the forward direction with respect to the inner surface of the shell 111 or the inner circumferential surface of the shell 111 adjacent to the second shell cover 113 through a separate bracket (not shown) coupled to the second shell cover 113.

The first support guide 117*b* may be formed in a cylindrical shape. A cross section of the first support guide 117*b* may have a plurality of diameters. A front side of the first support guide 117*b* may be inserted into a central opening of the second support spring 117, and a rear side of the first support guide 117*b* may be inserted into a central opening of the discharge cover assembly 180. A support cover 117*c* may be coupled to the front side of the first support guide 117*b* with the second support spring 117 interposed therebetween. A cup-shaped second support guide 117*d* that is recessed forward may be coupled to the front side of the support cover 117*c*. A cup-shaped third support guide 117*e* that corresponds to the second support guide 117*d* and is recessed rearward may be coupled to the inside of the second shell cover 113. The second support guide 117*d* may be inserted into the third support guide 117*e* and may be supported in the axial direction and/or the radial direction. In this instance, a gap may be formed between the second support guide 117*d* and the third support guide 117*e*.

The frame 120 may include a body portion 121 supporting the outer circumferential surface of the cylinder 140, and a first flange portion 122 that is connected to one side of the body portion 121 and supports the drive unit 130. The frame 120 may be elastically supported with respect to the casing 110 by the first and second support springs 116 and 117 together with the drive unit 130 and the cylinder 140.

The body portion 121 may wrap the outer circumferential surface of the cylinder 140. The body portion 121 may be formed in a cylindrical shape. The first flange portion 122 may extend from a front end of the body portion 121 in the radial direction.

The cylinder 140 may be coupled to an inner circumferential surface of the body portion 121. An inner stator 134 may be coupled to an outer circumferential surface of the body portion 121. For example, the cylinder 140 may be pressed and fitted to the inner circumferential surface of the body portion 121, and the inner stator 134 may be fixed using a separate fixing ring (not shown).

An outer stator 131 may be coupled to a rear surface of the first flange portion 122, and the discharge cover assembly 180 may be coupled to a front surface of the first flange portion 122. For example, the outer stator 131 and the discharge cover assembly 180 may be fixed through a mechanical coupling means.

On one side of the front surface of the first flange portion 122, a bearing inlet groove 125*a* forming a part of the gas bearing may be formed, a bearing communication hole 125*b* penetrating from the bearing inlet groove 125*a* to the inner circumferential surface of the body portion 121 may be formed, and a gas groove 125*c* communicating with the bearing communication hole 125*b* may be formed on the inner circumferential surface of the body portion 121.

The bearing inlet groove 125*a* may be recessed to a predetermined depth along the axial direction. The hearing communication hole 125*b* is a hole having a smaller cross-sectional area than the bearing inlet groove 125*a* and may be inclined toward the inner circumferential surface of the body portion 121. The gas groove 125*c* may be formed in an annular shape having a predetermined depth and an axial length on the inner circumferential surface of the body portion 121. Alternatively, the gas groove 125*c* may be formed on the outer circumferential surface of the cylinder 140 in contact with the inner circumferential surface of the body portion 121, or formed on both the inner circumferential surface of the body portion 121 and the outer circumferential surface of the cylinder 140.

In addition, a gas inlet 142 corresponding to the gas groove 125*c* may be formed on the outer circumferential surface of the cylinder 140. The gas inlet 142 forms a kind of nozzle in the gas bearing.

The frame 120 and the cylinder 140 may be formed of aluminum or an aluminum alloy material.

The cylinder 140 may be formed in a cylindrical shape in which both ends are opened. The piston 150 may be inserted through a rear end of the cylinder 140. A front end of the cylinder 140 may be closed via a discharge valve assembly 170. The compression space 103 may be formed between the cylinder 140, a front end of the piston 150, and the discharge valve assembly 170. Here, the front end of the piston 150 may be referred to as a head portion 151. The volume of the compression space 103 increases when the piston 150 moves backward, and decreases as the piston 150 moves forward. That is, the refrigerant introduced into the compression space 103 may be compressed while the piston 150 moves forward, and may be discharged through the discharge valve assembly 170.

The cylinder 140 may include a second flange portion 141 disposed at the front end. The second flange portion 141 may bend to the outside of the cylinder 140. The second flange portion 141 may extend in an outer circumferential direction of the cylinder 140. The second flange portion 141 of the cylinder 140 may be coupled to the frame 120. For example, the front end of the frame 120 may include a flange groove corresponding to the second flange portion 141 of the cylinder 140, and the second flange portion 141 of the cylinder 140 may be inserted into the flange groove and coupled through a coupling member.

A gas bearing means may be provided to supply a discharge gas to a gap between an outer circumferential surface of the piston 150 and an inner circumferential surface of the cylinder 140 and lubricate between the cylinder 140 and the piston 150 with gas. The discharge gas between the cylinder 140 and the piston 150 may provide a levitation force to the piston 150 to reduce a friction generated between the piston 150 and the cylinder 140.

For example, the cylinder 140 may include the gas inlet 142. The gas inlet 142 may communicate with the gas groove 125*c* formed on the inner circumferential surface of the body portion 121. The gas inlet 142 may pass through the cylinder 140 in the radial direction. The gas inlet 142 may guide the compressed refrigerant introduced in the gas groove 125*c* between the inner circumferential surface of the cylinder 140 and the outer circumferential surface of the piston 150. Alternatively, the gas groove 125*c* may be formed on the outer circumferential surface of the cylinder 140 in consideration of the convenience of processing.

An entrance of the gas inlet 142 may be formed relatively widely, and an exit of the gas inlet 142 may be formed as a fine through hole to serve as a nozzle. The entrance of the gas inlet 142 may further include a filter (not shown) blocking the inflow of foreign matter. The filter may be a metal mesh filter, or may be formed by winding a member such as fine thread.

The plurality of gas inlets 142 may be independently formed. Alternatively, the entrance of the gas inlet 142 may be formed as an annular groove, and a plurality of exits may be formed along the annular groove at regular intervals. The gas inlet 142 may be formed only at the front side based on the axial direction center of the cylinder 140. On the contrary, the gas inlet 142 may be formed at the rear side based on the axial direction center of the cylinder 140 in consideration of the sagging of the piston 150.

The piston 150 is inserted into the opened rear end of the cylinder 140 and is provided to seal the rear of the compression space 103.

The piston 150 may include a head portion 151 and a sliding portion 152. The head portion 151 may be formed in a disc shape. The head portion 151 may be partially open. The head portion 151 may partition the compression space 103. The sliding portion 152 may extend rearward from a radially outer edge of the head portion 151. The sliding portion 152 may be formed in a cylindrical shape. The inside of the sliding portion 152 may be empty, and a front of the sliding portion 152 may be partially sealed by the head portion 151. A rear of the sliding portion 152 may be opened and connected to the muffler unit 160. The head portion 151 may be provided as a separate member coupled to the sliding portion 152. Alternatively, the head portion 151 and the sliding portion 152 may be formed as one body.

The linear compressor 100 may include the elastic body 191. The elastic body 191 may be disposed in the piston 150. An outer end of the elastic body 191 may be coupled to an inner circumferential surface of the piston 150. A radially central area of the elastic body 191 may be coupled to one side of the rod 192. The piston 150 may be elastically supported axially and/or radially by the elastic body 191 coupled to one side of the rod 192.

Referring to FIGS. 4 and 7, the elastic body 191 may extend radially outward about the axis. The elastic body 191 may be radially disposed and may be a leaf spring formed in a disk shape. An outer edge of the elastic body 191 may be integrally formed. When the outer edge of the elastic body 191 is integrally formed, a coupling force with an inner circumferential surface of the sliding portion 152 can be improved, and the behavior of the piston 150 can be easily controlled.

When the elastic body 191 is formed of the leaf spring, radial elasticity may be stronger than axial elasticity. When the elastic body 191 has the stronger radial elasticity than the axial elasticity, the eccentricity of the supporter 119 with respect to the elastic body 191 can be minimized. When the axial elasticity of the elastic body 191 is weak, flexible tilting may be possible.

Specifically, the supporter 119 may be elastically supported by a plurality of resonant springs 118 coupled to a spring seat portion 119*c*. The supporter 119 may be a mover that is coupled to a magnet frame 136, to which a magnet 135 is coupled, and reciprocates axially. In this case, the alignment between the axis of the linear compressor 100 and the axis of the supporter 119 may be misaligned. When the piston 150 is not flexibly tilted with respect to the supporter 119, the axial alignment of the piston 150 with respect to the cylinder 140 may also be misaligned. Therefore, a friction and/or contact may occur between the piston 150 and the cylinder 140. The friction may wear and damage the components.

When the elastic body 191 is formed of the leaf spring, a tilting freedom of the piston 150 with respect to the supporter 119 may increase. Therefore, the piston 150 can easily maintain the axial alignment by the gas bearing on the inside of the cylinder 140. At the same time as this, since the eccentricity of the supporter 119 and/or the magnet frame 136 with respect to the piston 150 can be reduced, a gap in the drive unit 130 can be kept relatively constant. Through this, since the contact and/or friction between the components can be reduced, a damage of the component and noise generation can be prevented. Hence, the reliability of the linear compressor 100 can be improved, and the efficiency of the linear compressor 100 can also be improved.

The elastic body 191 may include a plurality of first flow holes 191*a*. The refrigerant may flow axially from the inside of the piston 150 through the plurality of first flow holes 191*a*.

The plurality of first flow holes 191*a* may be disposed radially about the axis. Each of the plurality of first flow holes 191*a* may be formed in a spiral shape away from the axis. Alternatively, the plurality of first flow holes 191*a* may be formed in various shapes so as to secure the proper elasticity of the elastic body 191. The plurality of first flow holes 191*a* may be understood as slits formed between elastic elements of the leaf spring. Accordingly, the elasticity of the elastic body 191 may be controlled by adjusting the shape, the size, or the number of the plurality of first flow holes 191*a*.

An intake port 154 may axially overlap at least a part of the plurality of first flow holes 191*a*. In the linear compressor 100 according to the first embodiment of the present disclosure, the refrigerant coming from the muffler unit 160 passes through the plurality of first flow holes 191*a* of the elastic body 191, and then is introduced into the compression space 103 through the intake port 154. In this instance, when the intake port 154 axially overlaps the plurality of first flow holes 191*a*, the refrigerant passing through the plurality of first flow holes 191*a* can be smoothly introduced into the intake port 154.

When viewed axially, a sum of the areas of the plurality of first flow holes 191*a* may he greater than a sum of the areas of the intake ports 154. When the sum of the areas of the plurality of first flow holes 191*a* is greater than the sum of the areas of the intake ports 154, the present disclosure can prevent a problem in which an amount of the refrigerant introduced into the intake port 154 decreases.

When viewed axially, the sum of the areas of the plurality of first flow holes 191*a* may be greater than the area of a cross-section of a narrowest portion of an internal flow path 105 formed inside the muffler unit 160. When the sum of the areas of the plurality of first flow holes 191*a* is at least greater than a cross-sectional area of the narrowest portion of a cross-section of the internal flow path 105 formed inside the muffler unit 160, the refrigerant passing through the internal flow path 105 can entirely reach the intake port 154.

Referring to (a) of FIG. 6, the sliding portion 152 may include a groove 193. The groove 193 is formed on the inner circumferential surface of the sliding portion 152, and the elastic body 191 may be coupled to the groove 193. The groove 193 may be formed in a circumferential direction at a portion coupled to an outer circumferential surface of the elastic body 191. A radius of the elastic body 191 may be larger than a radius of an inner circumferential surface of a portion of the sliding portion 152 in which the groove 193 is not formed. The radius of the elastic body 191 may be formed to have a radius corresponding to a radius of the groove 193. The elastic body 191 may be coupled to the piston 150 as the outer circumferential surface of the elastic body 191 is seated on the groove 193 formed on the inner circumferential surface of the sliding portion 152. The groove 193 may guide the position of the elastic body 191 with respect to the piston 150.

Alternatively, the groove 193 may be formed only in a portion of an area contacting the elastic body 191. For example, three grooves 193 may be formed in the circumferential direction at intervals of 120 degrees around the axis. In this case, a plurality of protrusions (not shown) may be formed at positions where the grooves 193 are formed at the outer circumferential surface of the elastic body 191. The elastic body 191 may be coupled to the piston 150 as the plurality of protrusions (not shown) are seated on the grooves 193. A radius of a portion of the elastic body 191 where the plurality of protrusions (not shown) are not formed may be equal to or less than a radius of the inner circumferential surface of the sliding portion 152. The groove 193 may guide a rotation direction position.

Referring to (b) and (c) of FIG. 6, a first coupling groove 194 may be formed on one of the outer circumferential surface of the elastic body 191 and the inner circumferential surface of the sliding portion 152, and the other may include a coupling protrusion 195 coupled to the first coupling groove 194. The coupling protrusion 195 may be formed as a separate member from the elastic body 191 and/or the piston 150.

Referring to (b) of FIG. 6, a seating groove 196 in which the coupling protrusion 195 can be seated may be formed on the outer circumferential surface of the elastic body 191, and a spring 197 may be disposed in the seating groove 196. The elastic body 191 may be coupled to the piston 150 in such a way that the elastic body 191 is inserted from the rear of the piston 150. When the elastic body 191 is inserted from the rear of the piston 150, the coupling protrusion 195 may be pressed. Further, when the coupling protrusion 195 is disposed at the position where the first coupling groove 194 is formed, the coupling protrusion 195 may protrude outward by an elastic force of the spring 197 disposed in the seating groove 196. Hence, the elastic body 191 may be fixed to the first coupling groove 194.

Referring to (c) of FIG. 6, a seating groove 196 in which the coupling protrusion 195 can be seated may be formed on the inner circumferential surface of the sliding portion 152. A spring 197 may be disposed in the seating groove 196. The elastic body 191 may be coupled to the piston 150 in such a way that the elastic body 191 is inserted from the rear of the piston 150. When the elastic body 191 is inserted from the rear of the piston 150, the coupling protrusion 195 may be pressed. Further, when the first coupling groove 194 is disposed at the position where the coupling protrusion 195 is formed, the coupling protrusion 195 may protrude inward by an elastic force of the spring 197 disposed in the seating groove 196. Hence, the elastic body 191 may be fixed to the first coupling groove 194.

The first coupling groove 194 and/or the coupling protrusion 195 may be formed in the circumferential direction. That is, the first coupling groove 194 and/or the coupling protrusion 195 may be formed in a ring shape. Alternatively, the first coupling groove 194 and/or the coupling protrusion 195 may be formed in a part of the circumference. For example, three first coupling grooves 194 may be formed on the inner circumferential surface of the sliding portion 152 in the circumferential direction at intervals of 120 degrees around the axis. In addition, three coupling protrusions 195 may be formed at positions corresponding to the positions where the first coupling grooves 194 are formed on the outer circumferential surface of the elastic body 191.

Referring to (d) of FIG. 6, the outer circumferential surface of the elastic body 191 may be formed of a male screw. A portion to which the elastic body 191 is coupled on the inner circumferential surface of the sliding portion 152 may be formed of a female screw. The elastic body 191 may be screw-coupled to the inner circumferential surface of the sliding portion 152. In this case, the elastic body 191 can be simply coupled to the piston 150 without a separate member.

A radius of a rear portion of the elastic body 191 at the inner circumferential surface of the sliding portion 152 may be greater than the radius of the elastic body 191. Through this, when the elastic body 191 is inserted from the rear of the piston 150, the elastic body 191 does not interfere with the inner circumferential surface of the sliding portion 152 and may be disposed at the coupling position. A radius of a front portion of the elastic body 191 at the inner circumferential surface of the sliding portion 152 may be less than the radius of the elastic body 191 at the inner circumferential surface of the sliding portion 152. In this case, a portion having a small radius in the inner circumferential surface of the sliding portion 152 may serve as a stopper when the elastic body 191 is screw-coupled to the inner circumferential surface of the sliding portion 152.

A rotation direction in which the elastic body 191 is screw-coupled to the rod 192 and a rotation direction in which the sliding portion 152 is screw-coupled to the elastic body 191 may be the same. For example, when a direction in which the elastic body 191 is screw-coupled to one side of the rod 192 is a right-handed screw direction, a direction in which the piston 150 is screw-coupled to the elastic body 191 may be the right-handed screw direction. Through this, when the piston 150 is screw-coupled to the elastic body 191, the elastic body 191 can be tightened at the same time. Hence, the piston 150, the elastic body 191, and the rod 192 can be firmly coupled.

Unlike the configuration illustrated in FIGS. 2 to 7, the elastic body 191 and the piston 150 may be integrally formed. Specifically, the elastic body 191 may extend to a radially inner side of the sliding portion 152 and may be coupled to one side of the rod 192 in a radially central area. In this case, since the piston 150 can be coupled to the supporter 119 without a separate process of coupling the elastic body 191 to the piston 150, the manufacturing process can be simplified. For example, a coupling hole **191*b* to which one side of the rod 192 can be coupled may be formed in the radially central area of the elastic body 191, the coupling hole 191*b* may be formed of a female screw, and one side of the rod 192 may be formed of a male screw. In this case, the piston 150 integrally formed with the elastic body 191 may be coupled to one side of the rod 192** by turning it.

The linear compressor 100 may include the rod 192. The rod 192 may extend axially. The rod 192 may be disposed inside the internal flow path 105 that is formed inside the muffler unit 160 and extends axially. One side of the rod 192 may be coupled to the radially central area of the elastic body 191, and other side may be connected to a radially central area of a plate **119*b*. An elastic force of the resonant spring 118 may be transmitted to the rod 192 through the supporter 119. The elastic force transmitted to the rod 192 may be transmitted to the piston 150 through the elastic body 191**.

The rod 192 may be formed of a rigid material. If the rod 192 is formed of an elastic material, eccentricity of the supporter 119 and the magnet frame 136 connected to the supporter 119 may occur even if the axial alignment of the piston 150 is maintained at the inner circumferential surface of the cylinder 140. In this case, it may be difficult for the magnet 135 coupled to the magnet frame 136 to maintain a constant gap between the outer stator 131 and the inner stator 134. If the gap of the drive unit 130 is not constant, the efficiency of the linear compressor 100 may be reduced, and a contact and/or friction between the outer stator 131 and/or the inner stator 134 and the magnet 135 may occur. This may cause problems of component damage and noise generation. When the rod 192 is formed of the rigid material, the axial alignment of the piston 150 can be achieved, and at the same time, the eccentricity of the supporter 119 and/or the magnet frame 136 can be prevented. Through this, the present disclosure can solve the problems of component damage and noise generation that may occur in the gap of the drive unit 130, and can improve the efficiency of the linear compressor 100.

When the rod 192 is formed of the rigid material, elastic deformation occurs only in the elastic body 191. Therefore, a rotation point of the piston 150 can be easily designed. Through this, the behavior of the piston 150 can be easily controlled.

The elastic body 191 and the rod 192 may be rigidly coupled. For example, the elastic body 191 and the rod 192 may be screw-coupled. Specifically, the rod 192 may be formed of a male screw. Further, the elastic body 191 may include the coupling hole **191*b* that is formed of a female screw in the radially central area of the elastic body 191. The coupling hole 191*b* may be screw-coupled to one side of the rod 192. Through this, the elastic body 191 can be simply coupled to the rod 192 without a separate coupling member. In addition, when the rod 192 is formed of the rigid material and is rigidly coupled to the elastic body 191, an elastically deformed portion is limited to the elastic body 191. Therefore, the rotation point of the piston 150 can be easily designed. In addition, since the flexibility of the tilting of the piston 150 can be adjusted only by coupling the elastic body 191 with the proper elasticity to the behavior of the piston 150, the behavior of the piston 150** can be easily controlled.

Unlike the configuration illustrated in FIGS. 2 to 7, the elastic body 191 and the rod 192 may be integrally formed. When the elastic body 191 and the rod 192 are integrally formed, it is possible to prevent problems, such as noise generation, due to a gap that may occur at a coupling portion of the elastic body 191 and the rod 192. In addition, since the elastic body 191 and the rod 192 can be manufactured at once through a single manufacturing process, the manufacturing process can be simplified.

The piston 150 may include the intake port 154. The intake port 154 may pass through the head portion 151. The intake port 154 may communicate the intake space 102 and the compression space 103 inside the piston 150 with each other. For example, the refrigerant flowing from the accommodation space 101 to the intake space 102 inside the piston 150 may pass through the intake port 154 and may be sucked into the compression space 103 between the piston 150 and the cylinder 140. The refrigerant may flow from the intake space 102 to the compression space 103 through the intake port 154. The intake port 154 may axially overlap at least a part of the plurality of first flow holes 191*a*. When viewed axially, a sum of the areas of the plurality of first flow holes 191*a* formed in the elastic body 191 may be greater than a sum of the areas of the intake ports 154.

The intake port 154 may extend in an axial direction of the piston 150. The intake port 154 may be inclined along the axial direction of the piston 150. For example, the intake port 154 may extend to be inclined in a direction away from the central axis as it goes to the rear of the piston 150.

A cross section of the intake port 154 may be formed in a circular shape. The intake port 154 may have a constant inner diameter. Alternatively, the intake port 154 may be formed as a long hole in which an opening extends in the radial direction of the head portion 151, and may be configured such that the inner diameter becomes larger as it goes to the rear.

The plurality of intake ports 154 may be formed in at least one of the radial direction and the circumferential direction of the head portion 151.

The head portion 151 of the piston 150 adjacent to the compression space 103 may be provided with an intake valve 155 for selectively opening and closing the intake port 154. The intake valve 155 may operate by elastic deformation to open or close the intake port 154. That is, the intake valve 155 may pass through the intake port 154 and may be elastically deformed to open the intake port 154 by a pressure of the refrigerant flowing into the compression space 103.

The piston 150 may be connected to a magnet 135. The magnet 135 may reciprocate forward and backward in response to the movement of the piston 150. The inner stator 134 and the cylinder 140 may be disposed between the magnet 135 and the piston 150. The magnet 135 and the piston 150 may be connected to each other by the magnet frame 136 that is formed by detouring the cylinder 140 and the inner stator 134 to the rear.

The linear compressor 100 may include the muffler unit 160. The muffler unit 160 may be inserted into the piston 150 from the rear of the piston 150. The muffler unit 160 may be disposed at the rear of the elastic body 191. The muffler unit 160 may reduce noise generated in the process of introducing the refrigerant into the piston 150. The refrigerant sucked through the intake pipe 114 may flow into the intake space 102 in the piston 150 via the muffler unit 160.

Referring to FIG. 5, the muffler unit 160 may be formed as a single member, or may be formed by combining a plurality of members. The muffler unit 160 may be coupled to the piston 150 to reciprocate axially together with the piston 150. The muffler unit 160 may reduce the noise generated in the compression space 103.

The muffler unit 160 may include the internal flow path 105. The internal flow path 105 may be formed inside the muffler unit 160. The internal flow path 105 may extend axially. A front end of the internal flow path 105 may communicate with the intake space 102 formed inside the piston 150, and a rear end of the internal flow path 105 may communicate with the accommodation space 101 formed inside the casing 110. The internal flow path 105 may communicate from a rear end to a front end of the muffler unit 160. The internal flow path 105 may be understood as a passage through which the refrigerant introduced from the rear end of the muffler unit 160 can flow to the front of the muffler unit 160.

A radius of the internal flow path 105 may increase as it goes to the axial front. A radially outer portion of the plurality of first flow holes 191*a* formed in the elastic body 191 may be formed to be wider than a radially inner portion of the plurality of first flow holes 191*a*. Further, in order to secure the proper elasticity of the intake valve 155, the intake port 154 formed in the head portion 151 of the piston 150 may also be formed to be biased radially outward. Therefore, when a radius of the front end of the internal flow path 105 increases as it goes to the front axially, the refrigerant can be guided radially outward while flowing from the radial rear to the radial front. Therefore, the refrigerant passing through the internal flow path 105 can be more effectively introduced into the plurality of first flow holes 191*a* and/or the intake ports 154.

A refrigerant inlet 163 may be formed at the rear end of the internal flow path 105. The refrigerant inlet 163 may be formed to have a radius to the extent that it can axially overlap some or all of second flow holes 119*d* formed in the plate 119*b*. The refrigerant introduced from the rear of the casing 110 is introduced into the refrigerant inlet 163 through the second flow hole 119*d*. In this instance, when the refrigerant inlet 163 and the second flow hole 119*d* formed in the plate 119*b* axially overlap each other, the refrigerant introduced from the rear of the plate 119*b* can be effectively introduced into the muffler unit 160.

The muffler unit 160 may include a noise space 106. The noise space 106 may be formed on a radially outer side of the internal flow path 105. The internal flow path 105 and the noise space 106 may communicate with each other. A radius of an inner circumferential surface of the noise space 106 may be greater than a radius of an inner circumferential surface of the internal flow path 105.

Referring to FIG. 5, all or part of the noise space 106 may be disposed in the noise space 106. That is, when the muffler unit 160 is inserted into the inside of the piston 150 from the rear of the piston 150, all or part of the noise space 106 may be inserted into the piston 150.

Unlike the configuration illustrated in FIG. 5, the noise space 106 may be disposed at the rear of the piston, and the internal flow path 105 may extend to the front of the noise space 106 and may be disposed inside the piston 150.

When the linear compressor 100 is driven, the refrigerant may be compressed in the compression space 103 inside the cylinder by an axial reciprocating motion of the piston 150, and may be discharged to the discharge space 104. In this process, a pressure of the refrigerant may change, and a compression noise of the refrigerant may occur. The compression noise generated in the compression space 103 and the piston 150 may move backward along the internal flow path 105. The compression noise generated in the front of the piston 150 may be radiated to the noise space 106 while moving backward along the internal flow path 105. When the internal flow path 105 passes through the noise space 106, a cross-sectional area of a flow path through which the refrigerant passes rapidly increases. Therefore, a sound pressure of the compression noise can be reduced, and the compression noise may be attenuated. In addition, the compressed noise entering the noise space 106 may be dissipated while being reflected on an inner wall of the noise space 106.

The linear compressor 100 may include the resonant spring 118. The resonant spring 118 may amplify a vibration implemented by the reciprocating motion of the magnet 135 and the piston 150 to thereby achieve the effective compression of the refrigerant. Specifically, the resonant spring 118 may be adjusted to a frequency corresponding to the natural frequency of the piston 150 and may allow the piston 150 to perform a resonant motion. Further, the resonant spring 118 may induce a stable movement of the piston 150 to reduce vibration and noise generation.

The resonant spring 118 may be a coil spring extending axially. Both ends of the resonant spring 118 may be connected to a vibrating body and a fixed body, respectively. For example, one end of the resonant spring 118 may be connected to the magnet frame 136, and other end may be connected to the back cover 123. Thus, the resonant spring 118 may be elastically deformed between the vibrating body vibrating at one end and the fixed body fixed at the other end.

The natural frequency of the resonant spring 118 is designed to match a resonance frequency of the magnet 135 and the piston 150 during operation of the linear compressor 100, thereby amplifying the reciprocating motion of the piston 150. However, since the back cover 123 provided as the fixed body is elastically supported on the casing 110 through the first support spring 116, the back cover 123 may not be strictly fixed.

The resonant spring 118 may include a first resonant spring 118*a* supported on a rear side of the supporter 119 based on the supporter 119 and a second resonant spring 118*b* supported on a front side of the supporter 119.

The linear compressor 100 may include the supporter 119. The supporter 119 may serve to transmit an elastic of the resonant spring 118 to the piston 150.

The supporter 119 may include a body portion 119*a*, a spring seat portion 119*c* extending to a radially outer side of the body portion 119*a*, and the plate 119*b* extending to a radially inner side of the body portion 119*a*.

The supporter 119 may include the plate 119*b*. A radially central area of the plate 119*b* may be coupled to the other side of the rod 192.

The plate 119*b* may be connected to the rod 192. The plate 119*b* and the rod 192 may be integrally formed. When the plate 119*b* and the rod 192 are integrally formed, it is possible to prevent a problem such as noise generation due to a gap that may occur at a fastening portion. Further, when the supporter 119 and the rod 192 are integrally formed, the elastic force of the resonant spring 118 transmitted to the supporter 119 can be fully transmitted to the rod 192. Therefore, the elastic force of the resonant spring 118 can be effectively transmitted to the piston 150. In addition, since the supporter 119 and the rod 192 can be manufactured at once through a single manufacturing process, the manufacturing process can be simplified.

Alternatively, the plate 119*b* and the rod 192 may be rigidly coupled. For example, a male screw is formed in one of the other side of the rod 192 and the radially central area of the plate 119*b*, and a female screw is formed in the other, so that the rod 192 can be screw-coupled to the plate 119*b*. Through this, the rod 192 can be simply coupled to the plate 119*b* without a separate coupling member.

A direction in which the elastic body 191 is screw-coupled to one side of the rod 192 and a direction in which the rod 192 is screw-coupled to the plate 119*b* may be the same. For example, when the direction in Which the elastic body 191 is screw-coupled to one side of the rod 192 is a right-handed screw direction, a direction in which the other side of the rod 192 is screw-coupled to the radially central area of the plate 119*b* may be the right-handed screw direction. Through this, when the elastic body 191 is screw-coupled to one side of the rod 192, the rod 192 can be tightened to the plate 119*b* at the same time. Hence, the elastic body 191, the rod 192, and the plate 119*b* can be firmly coupled.

The plate 119*b* may include the second flow hole 119*d*. The second flow hole 119*d* may be formed on a radially outer side of the rod 192. When viewed axially, the second flow hole 119*d* may be formed in an inner area of the inner circumferential surface of the sliding portion 152 of the piston 150. The refrigerant introduced from the rear of the casing 110 through the second flow hole 119*d* may be introduced into the muffler unit 160.

The plurality of second flow holes 119*d* may be provided. For example, three second flow holes 119*d* may be formed about the axis, and the plurality of second flow holes 119*d* may be formed radially about the axis. The present disclosure is not limited thereto, and the second flow holes 119*d* may be formed in various numbers.

The refrigerant inlet 163 formed at the rear end of the muffler unit 160 may be formed to have a radius to the extent that it can axially overlap some or all of the second flow holes 119*d* formed in the plate 119*b*. When the refrigerant inlet 163 axially overlaps some or all of the second flow holes 119*d*, the refrigerant can be effectively introduced into the muffler unit 160 as described above.

The plate 119*b* may include a third flow hole 119*e*. The third flow hole 119*e* may be formed in a radially outer portion of the plate 119*b*. The refrigerant in the accommodation space 101 inside the casing 110 may flow through the third flow hole 119*e*. The third flow hole 119*e* may guide the refrigerant, that has not been yet introduced into the front of the plate 119*b* through the second flow hole 119*d*, to the front of the plate 119*b*.

The supporter 119 may include the body portion 119*a*. The body portion 119*a* may be coupled to the outside of the plate 119*b*. The body portion 119*a* may be formed in a substantially cylindrical shape and may be formed in a shape surrounding an outer circumferential surface of the plate 119*b*.

An opening 119*f* opened radially may be formed on a side surface of the body portion 119*a*. Through the opening 119*f* formed on the side surface of the body portion 119*a*, not only the refrigerant at the rear of the plate 119*b* but also the refrigerant at the radially outer side of the body portion 119*a* may be introduced into the inside of the body portion 119*a*, and then may be introduced into the muffler unit 160 through the second flow hole 119*d* and/or the third flow hole 119*e*. The efficiency of the linear compressor 100 can be improved by using the refrigerant filled in the inside of the accommodation space 101 through the opening 119*f* as efficiently as possible as described above.

The body portion 119*a* may include a portion extending to the front of the plate 119*b*. In this instance, a radius R1 of an inner circumferential surface of a front end of the body portion 119*a* may be less than a radius R2 of the plate 119*b*. A portion of the body portion 119*a* disposed in front of the plate 119*b* may have a shape in which the radius of the inner circumferential surface deceases as it goes to the front. The portion of the body portion 119*a* disposed in front of the plate 119*b* may be understood to have a funnel shape. Through this, the refrigerant flowing in the front of the plate 119*b* through the third flow hole 119*e* from the rear of the plate 119*b* and/or the outside of the body portion 119*a* can be guided radially inward. The refrigerant guided radially inward can be effectively introduced into the muffler unit 160, and the efficiency of the linear compressor 100 can be improved.

The supporter 119 may include the spring seat portion 119*c*. The spring seat portion 119*c* may extend radially outward from the outer circumferential surface of the body portion 119*a*. The plurality of spring seat portions 119*c* may be provided. The plurality of spring seat portions 119*c* may be disposed radially about the axis.

The first resonant spring 118*a* may be disposed between a rear surface of a stator cover 137 and a front surface of the spring seat portion 119*c*. The plurality of first resonant springs 118*a* may be provided. For example, when the three spring seat portions 119*c* are provided, the plurality of spring seat portions 119*c* may be disposed radially about the axis, and the first resonant springs 118*a* may be disposed in pairs for each spring seat portion 119*c* in the circumferential direction.

In this case, it may be understood that the three pairs of first resonant springs 118*a* are disposed radially about the axis. The plurality of first resonant springs 118*a* may be disposed to have symmetry about the axis. Through this, the present disclosure can minimize a lateral force generated from the plurality of first resonant springs 118*a*, and thus can prevent and/or eccentricity of the mover.

The second resonant spring 118*b* may be disposed between a rear surface of the spring seat portion 119*c* and a front surface of the back cover 123. The plurality of second resonant spring 118*b* may be provided. For example, when the three spring seat portions 119*c* are provided, the plurality of spring seat portions 119*c* may be disposed radially about the axis, and the second resonant springs 118*b* may be disposed in pairs for each spring seat portion 119*c* in the circumferential direction.

In this case, it may be understood that the three pairs of second resonant springs 118*b* are disposed radially about the axis. The plurality of second resonant springs 118*b* may be disposed to have symmetry about the axis. Through this, the present disclosure can minimize a lateral force generated from the plurality of second resonant springs 118*b*, and thus can prevent tilting and/or eccentricity of the mover.

The first resonant springs 118*a* and the second resonant springs 118*b* may be disposed axially side by side, or may be alternately disposed axially.

The discharge valve assembly 170 may include a discharge valve 171 and a valve spring 172 that is provided on a front side of the discharge valve 171 to elastically support the discharge valve 171. The discharge valve assembly 170 may selectively discharge the compressed refrigerant in the compression space 103. Here, the compression space 103 means a space between the intake valve 155 and the discharge valve 171.

The discharge valve 171 may be disposed to be supportable on the front surface of the cylinder 140. The discharge valve 171 may selectively open and close the front opening of the cylinder 140. The discharge valve 171 may operate by elastic deformation to open or close the compression space 103. The discharge valve 171 may be elastically deformed to open the compression space 103 by the pressure of the refrigerant flowing into the discharge space 104 through the compression space 103. For example, the compression space 103 may maintain a sealed state while the discharge valve 171 is supported on the front surface of the cylinder 140, and the compressed refrigerant of the compression space 103 may be discharged into an opened space in a state where the discharge valve 171 is spaced apart from the front surface of the cylinder 140.

The valve spring 172 may be provided between the discharge valve 171 and the discharge cover assembly 180 to provide axially an elastic force. The valve spring 172 may be provided as a compression coil spring, or may be provided as a leaf spring in consideration of an occupied space or reliability.

When the pressure of the compression space 103 is equal to or greater than a discharge pressure, the valve spring 172 may open the discharge valve 171 while deforming forward, and the refrigerant may be discharged from the compression space 103 and discharged into a first discharge space 104*a* of the discharge cover assembly 180. When the discharge of the refrigerant is completed, the valve spring 172 provides a restoring force to the discharge valve 171 and thus can allow the discharge valve 171 to be closed.

A process of introducing the refrigerant into the compression space 103 through the intake valve 155 and discharging the refrigerant of the compression space 103 into the discharge space 104 through the discharge valve 171 is described as follows.

In the process in which the piston 150 linearly reciprocates in the cylinder 140, when the pressure of the compression space 103 is equal to or less than a predetermined intake pressure, the intake valve 155 is opened and thus the refrigerant is sucked into a compression space 103. On the other hand, when the pressure of the compression space 103 exceeds the predetermined intake pressure, the refrigerant of the compression space 103 is compressed in a state in which the intake valve 155 is closed.

When the pressure of the compression space 103 is equal to or greater than the predetermined intake pressure, the valve spring 172 deforms forward and opens the discharge valve 171 connected to the valve spring 172, and the refrigerant is discharged from the compression space 103 to the discharge space 104 of the discharge cover assembly 180. When the discharge of the refrigerant is completed, the valve spring 172 provides a restoring force to the discharge valve 171 and allows the discharge valve 171 to be closed, thereby sealing a front of the compression space 103.

The discharge cover assembly 180 is installed at the front of the compression space 103, forms a discharge space 104 for receiving the refrigerant discharged from the compression space 103, and is coupled to a front of the frame 120 to thereby reduce a noise generated in the process of discharging the refrigerant from the compression space 103. The discharge cover assembly 180 may be coupled to a front of the first flange portion 122 of the frame 120 while receiving the discharge valve assembly 170. For example, the discharge cover assembly 180 may be coupled to the first flange portion 122 through a mechanical coupling member.

An O-ring 166 may be provided between the discharge cover assembly 180 and the frame 120 to prevent the refrigerant in a gasket 165 for thermal insulation and the discharge space 104 from leaking.

The discharge cover assembly 180 may be formed of a thermally conductive material. Therefore, when a high temperature refrigerant is introduced into the discharge cover assembly 180, heat of the refrigerant may be transferred to the casing 110 through the discharge cover assembly 180 and dissipated to the outside of the linear compressor.

The discharge cover assembly 180 may include one discharge cover, or may be arranged so that a plurality of discharge covers sequentially communicate with each other. When the discharge cover assembly 180 is provided with the plurality of discharge covers, the discharge space 104 may include a plurality of spaces partitioned by the respective discharge covers. The plurality of spaces may be disposed in a front-rear direction and may communicate with each other.

For example, when there are three discharge covers, the discharge space 104 may include a first discharge space 104*a* between the frame 120 and a first discharge cover 181 coupled to the front side of the frame 120, a second discharge space 104*b* between the first discharge cover 181 and a second discharge cover 182 that communicates with the first discharge space 104*a* and is coupled to a front side of the first discharge cover 181, and a third discharge space 104*c* between the second discharge cover 182 and a third discharge cover 183 that communicates with the second discharge space 104*b* and is coupled to a front side of the second discharge cover 182.

The first discharge space 104*a* may selectively communicate with the compression space 103 by the discharge valve 171, the second discharge space 104*b* may communicate with the first discharge space 104*a*, and the third discharge space 104*c* may communicate with the second discharge space 104*b*. Hence, as the refrigerant discharged from the compression space 103 sequentially passes through the first discharge space 104*a*, the second discharge space 104*b*, and the third discharge space 104*c*, a discharge noise can be reduced, and the refrigerant can be discharged to the outside of the casing 110 through the loop pipe 115*a* and the discharge pipe 115 communicating with the third discharge cover 183.

The drive unit 130 may include the outer stator 131 that is disposed between the shell 111 and the frame 120 and surrounds the body portion 121 of the frame 120, the inner stator 134 that is disposed between the outer stator 131 and the cylinder 140 and surrounds the cylinder 140, and the magnet 135 disposed between the outer stator 131 and the inner stator 134.

The outer stator 131 may be coupled to the rear of the first flange portion 122 of the frame 120, and the inner stator 134 may be coupled to the outer circumferential surface of the body portion 121 of the frame 120. The inner stator 134 may be spaced apart from the inside of the outer stator 131, and the magnet 135 may be disposed in a space between the outer stator 131 and the inner stator 134.

The outer stator 131 may be equipped with a winding coil, and the magnet 135 may include a permanent magnet. The permanent magnet may be comprised of a single magnet with one pole or configured by combining a plurality of magnets with three poles.

The outer stator 131 may include a coil winding body 132 surrounding the axial direction in the circumferential direction, and a stator core 133 stacked while surrounding the coil winding body 132. The coil winding body 132 may include a hollow cylindrical bobbin 132*a* and a coil 132*b* wound in a circumferential direction of the bobbin 132*a*. A cross section of the coil 132*b* may be formed in a circular or polygonal shape and, for example, may have a hexagonal shape. In the stator core 133, a plurality of lamination sheets may be laminated radially, or a plurality of lamination blocks may be laminated along the circumferential direction.

The front side of the outer stator 131 may be supported by the first flange portion 122 of the frame 120, and the rear side of the outer stator 131 may be supported by a stator cover 137. For example, the stator cover 137 may be provided in a hollow disc shape, a front surface of the stator cover 137 may be supported by the outer stator 131, and a rear surface of the stator cover 137 may be supported by a resonant spring 118.

The inner stator 134 may be configured by stacking a plurality of laminations on the outer circumferential surface of the body portion 121 of the frame 120 in the circumferential direction.

One side of the magnet 135 may be coupled to and supported by the magnet frame 136. The magnet frame 136 has a substantially cylindrical shape and may be disposed to be inserted into a space between the outer stator 131 and the inner stator 134. The magnet frame 136 may be coupled to the rear side of the piston 150 to move together with the piston 150.

As an example, a rear end of the magnet frame 136 is bent and extended inward radially to form a first coupling portion 136*a*, and the first coupling portion 136*a* may be coupled to a third flange portion 153 formed behind the piston 150. The first coupling portion 136*a* of the magnet frame 136 and the third flange portion 153 of the piston 150 may be coupled through a mechanical coupling member.

Further, a fourth flange portion 161*a* in front of the intake muffler 161 may be interposed between the third flange portion 153 of the piston 150 and the first coupling portion 136*a* of the magnet frame 136. Thus, the piston 150, the muffler unit 160, and the magnet 135 can linearly reciprocate together in a combined state.

When a current is applied to the drive unit 130, a magnetic flux may be formed in the winding coil, and an electromagnetic force may occur by an interaction between the magnetic flux formed in the winding coil of the outer stator 131 and a magnetic flux formed by the permanent magnet of the magnet 135 to move the magnet 135. At the same time as the axially reciprocating movement of the magnet 135, the piston 150 connected to the magnet frame 136 may also axially reciprocate integrally with the magnet 135.

The linear compressor 100 may include a plurality of sealing members that can increase a coupling force between the frame 120 and the components around the frame 120.

For example, the plurality of sealing members may include a first sealing member that is interposed at a portion where the frame 120 and the discharge cover assembly 180 are coupled, and is inserted into an installation groove provided at the front end of the frame 120, and a second sealing member that is provided at a portion where the frame 120 and the cylinder 140 are coupled, and is inserted into an installation groove provided at an outer surface of the cylinder 140. The second sealing member can prevent the refrigerant of the gas groove 125*c* between the inner circumferential surface of the frame 120 and the outer circumferential surface of the cylinder 140 from leaking to the outside, and can increase a coupling force between the frame 120 and the cylinder 140. The plurality of sealing members may further include a third sealing member that is provided at a portion where the frame 120 and the inner stator 134 are coupled, and is inserted into an installation groove provided at the outer surface of the frame 120. Here, the first to third sealing members may have a ring shape.

An operation of the linear compressor 100 described above is as follows.

First, when a current is applied to the drive unit 130, a magnetic flux may be formed in the outer stator 131 by the current flowing in the coil 132*b*. The magnetic flux formed in the outer stator 131 may generate an electromagnetic force, and the magnet 135 including the permanent magnet may linearly reciprocate by the generated electromagnetic force. The electromagnetic force may be alternately generated in a direction (forward direction) in which the piston 150 is directed toward a top dead center (TDC) during a compression stroke, and in a direction (rearward direction) in which the piston 150 is directed toward a bottom dead center (BDC) during an intake stroke. That is, the drive unit 130 may generate a thrust which is a force for pushing the magnet 135 and the piston 150 in a moving direction.

The piston 150 linearly reciprocating inside the cylinder 140 may repeatedly increase or reduce the volume of the compression space 103.

When the piston 150 moves in a direction (rearward direction) of increasing the volume of the compression space 103, a pressure of the compression space 103 may decrease. Hence, the intake valve 155 mounted in front of the piston 150 is opened, and the refrigerant remaining in the intake space 102 may be sucked into the compression space 103 along the intake port 154. The intake stroke may be performed until the piston 150 is positioned in the bottom dead center by maximally increasing the volume of the compression space 103.

The piston 150 reaching the bottom dead center may perform the compression stroke while switching its motion direction and moving in a direction (forward direction) of reducing the volume of the compression space 103. As the pressure of the compression space 103 increases during the compression stroke, the sucked refrigerant may be compressed. When the pressure of the compression space 103 reaches a setting pressure, the discharge valve 171 is pushed out by the pressure of the compression space 103 and is opened from the cylinder 140, and thus the refrigerant can be discharged into the discharge space 104 through a separation space. The compression stroke may continue while the piston 150 moves to the top dead center at which the volume of the compression space 103 is minimized.

As the intake stroke and the compression stroke of the piston 150 are repeated, the refrigerant introduced into the accommodation space 101 inside the linear compressor 100 through the intake pipe 114 may be introduced into the intake space 102 in the piston 150 by sequentially passing the intake guide 116*a*, the intake muffler 161, and the inner guide 162, and the refrigerant of the intake space 102 may be introduced into the compression space 103 in the cylinder 140 during the intake stroke of the piston 150. After the refrigerant of the compression space 103 is compressed and discharged into the discharge space 104 during the compression stroke of the piston 150, the refrigerant may be discharged to the outside of the linear compressor 100 via the loop pipe 115*a* and the discharge pipe 115.

Figure 8:
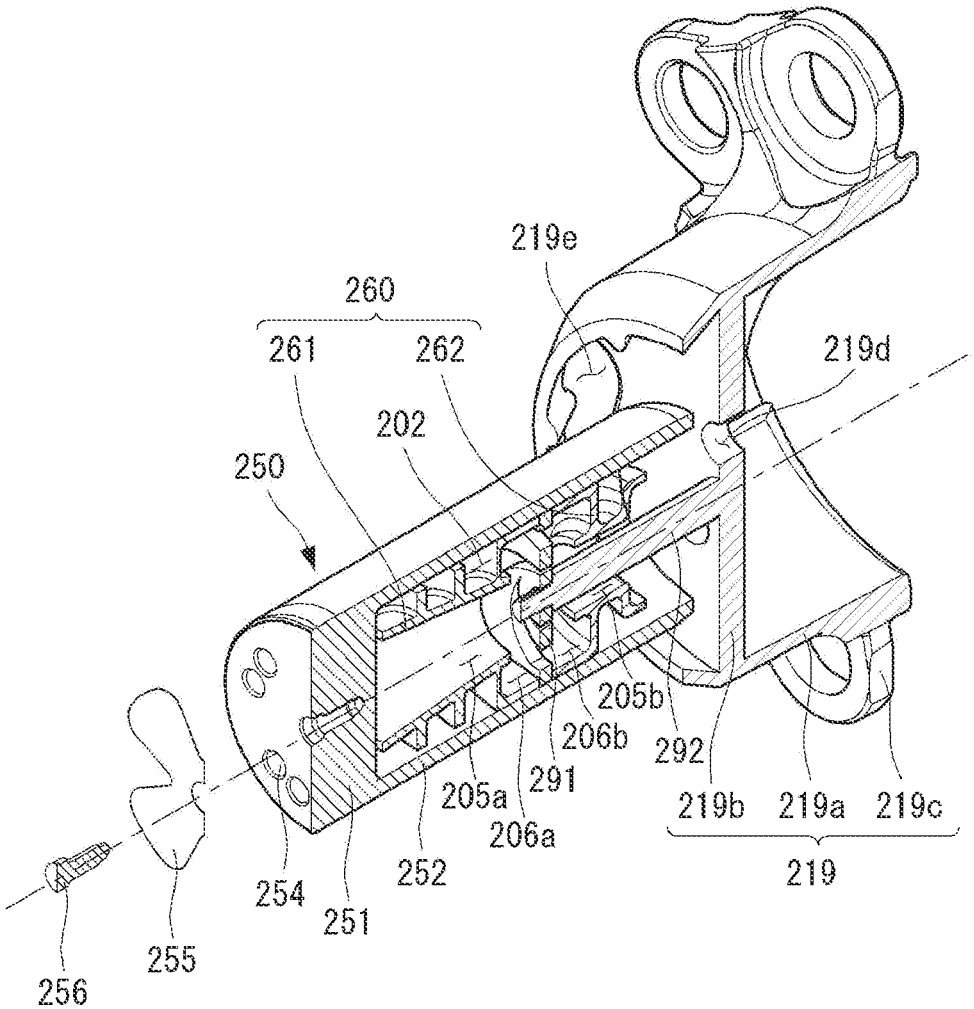
FIG. 8 is a cross-sectional perspective view of partial configuration of a linear compressor according to a second embodiment of the present disclosure.
Figure 9:
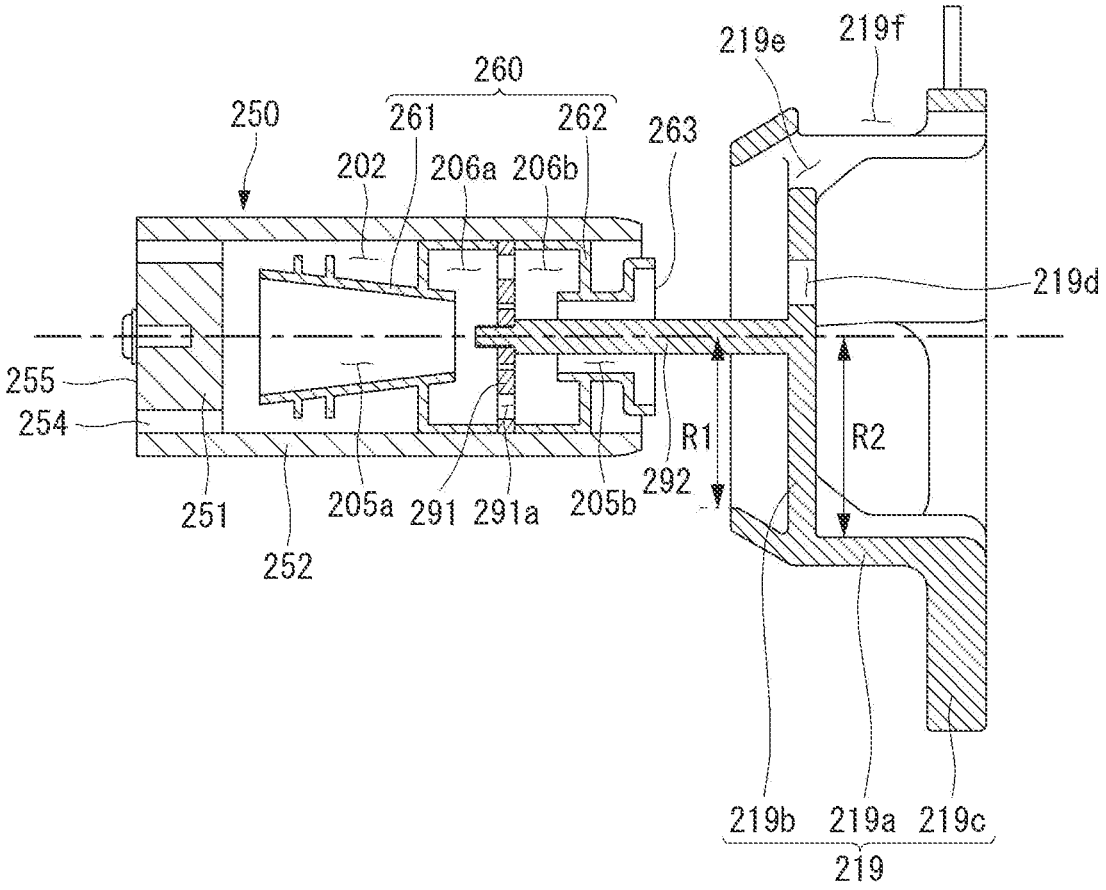
FIG. 9 is a cross-sectional view of partial configuration of a linear compressor according to a second embodiment of the present disclosure.

FIG. 8 is a cross-sectional perspective view of partial configuration of a linear compressor 200 according to a second embodiment of the present disclosure. FIG. 9 is a cross-sectional view of partial configuration of the linear compressor 200 according to the second embodiment of the present disclosure.

It can be understood that detailed configuration of the linear compressor 200 according to the second embodiment of the present disclosure illustrated in FIGS. 8 and 9, in which the description is omitted later, is the same as detailed configuration of the linear compressor 100 according to the first embodiment of the present disclosure illustrated in FIGS. 2 to 7.

The linear compressor 200 may include a muffler unit 260. The muffler unit 260 may be disposed in a piston 250. The muffler unit 260 may be formed as a single member, or may be formed by combining a plurality of members. The muffler unit 260 may be coupled to the piston 250 to axially reciprocate together with the piston 250. The muffler unit 260 may reduce a noise generated in a compression space 203.

Referring to FIGS. 8 and 9, the muffler unit 260 may include a guide member 261 and a muffler member 262. The muffler member 262 may be disposed at the rear of the guide member 261. Noise spaces 206*a* and 206*b* may be formed between the rear of the guide member 261 and the front of the muffler member 262.

The linear compressor 200 may include an elastic body 291. An outer end of the elastic body 291 may be disposed inside the piston 250. The piston 250 may be flexibly tilted from a supporter 219 through the elastic body 291. An inclination of the elastic body 291 may be variably changed with respect to the supporter 219. A detailed description thereof may be the same as described above with respect to the linear compressor 100 according to the first embodiment of the present disclosure.

The outer end of the elastic body 291 may be coupled to an inner circumferential surface of a sliding portion 252. A method of coupling the elastic body 291 to the inner circumferential surface of the sliding portion 252 may be the same as described above with reference to FIG. 6. A radially central area of the elastic body 291 may be coupled to one side of a rod 292. The elastic body 291 and one side of the rod 292 may be screw-coupled as described above. The rod 292 may be disposed inside a second internal flow path 205*b*.

The guide member 261 may be disposed in front of the elastic body 291. Specifically, a rear end of the guide member 261 may be disposed in close contact with a front surface of the elastic body 291. The muffler member 262 may be disposed at the rear of the elastic body 291. Specifically, a front end of the muffler member 262 may be disposed in close contact with a rear surface of the elastic body 291. In this case, the elastic body 291 may be disposed at a position Where the noise spaces 206*a* and 206*b* are formed.

The muffler unit 260 may include internal flow paths 205*a* and 205*b*. The internal flow paths 205*a* and 205*b* may be turned inside the muffler unit 260. The internal flow paths 205*a* and 205*b* may extend axially. Front ends of the internal flow paths 205*a* and 205*b* may communicate with an intake space 202 formed inside the piston 250, and rear ends of the internal flow paths 205*a* and 205*b* may communicate with an accommodation space 201 formed inside a casing 210.

The internal flow paths 205*a* and 205*b* may include a first internal flow path 205*a* and a second internal flow path 205*b*. The first internal flow path 205*a* and the second internal flow path 205*b* may be axially partitioned by the elastic body 291. The first internal flow path 205*a* and the second internal flow path 205*b* may communicate with each other by a plurality of first flow holes 291*a* formed in the elastic body 291.

The muffler unit 260 may form the noise spaces 206*a* and 206*b*. The noise spaces 206*a* and 206*b* may be formed on radially outer sides of the internal flow paths 205*a* and 205*b*. The internal flow paths 205*a* and 205*b* and the noise spaces 206*a* and 206*b* may communicate with each other. A radius of inner circumferential surfaces of the noise spaces 206*a* and 206*b* may be greater than a radius of inner circumferential surfaces of the internal flow paths 205*a* and 205*b*.

The noise spaces 206*a* and 206*b* may include a first noise space 206*a* and a second noise space 206*b*. The first noise space 206*a* and the second noise space 206*b* may be axially partitioned by the elastic body 291. Specifically, the first internal flow path 205*a* may extend to the front of the elastic body 291, and the second internal flow path 205*b* may extend to the rear of the elastic body 291. The first noise space 206*a* may be formed. radially outward in a rear end portion of the first internal flow path 205*a*. The second noise space 206*b* may be formed radially outward in a front end portion of the second internal flow path 205*b*.

When the noise spaces 206*a* and 206*b* are divided into the first noise space 206*a* and the second noise space 206*b*, a noise reduction effect may increase. Specifically, a compression noise generated in the compression space 203 and the piston may move rearward along the first internal flow path 205*a*. The compression noise moving rearward along the first internal flow path 205*a* may be radiated to the first noise space 206*a*. The compression noise radiated to the first noise space 206*a* may be radiated to the second noise space 206*b* through the plurality of first flow holes 291*a* formed in the elastic body 291. Since a flow path cross-sectional area of the plurality of first flow holes 291*a* is smaller than an induction cross-sectional area of the first noise space 206*a* and the second noise space 206*b*, the present disclosure can achieve the same effect as that obtained when the two noise spaces 206*a* and 206*b* are formed. The process of reducing the compression noise by the noise spaces 206*a* and 206*b* may be the same as described above with respect to the muffler unit 160 of the linear compressor 100 according to the first embodiment of the present disclosure.

Unlike the configuration illustrated in FIGS. 8 and 9, the elastic body 291 may be coupled to the inner circumferential surfaces of the noise spaces 206*a* and 206*b*. The elastic body 291 may be disposed between the guide member 261 and the muffler member 262 before the guide member 261 and the muffler member 262 are coupled to each other, and then the rear end of the guide member 261 and the front end of the muffler member 262 may be coupled. In this case, after the elastic body 291 is first assembled to the muffler unit 260, the muffler unit 260 may be coupled to the piston 250.

Alternatively, either the guide member 261 or the muffler member 262 and the elastic body 291 may be integrally formed, and the muffler unit 260 may be formed integrally and at the same time the elastic body 291 may also be formed integrally with the muffler unit 260.

Figure 10:
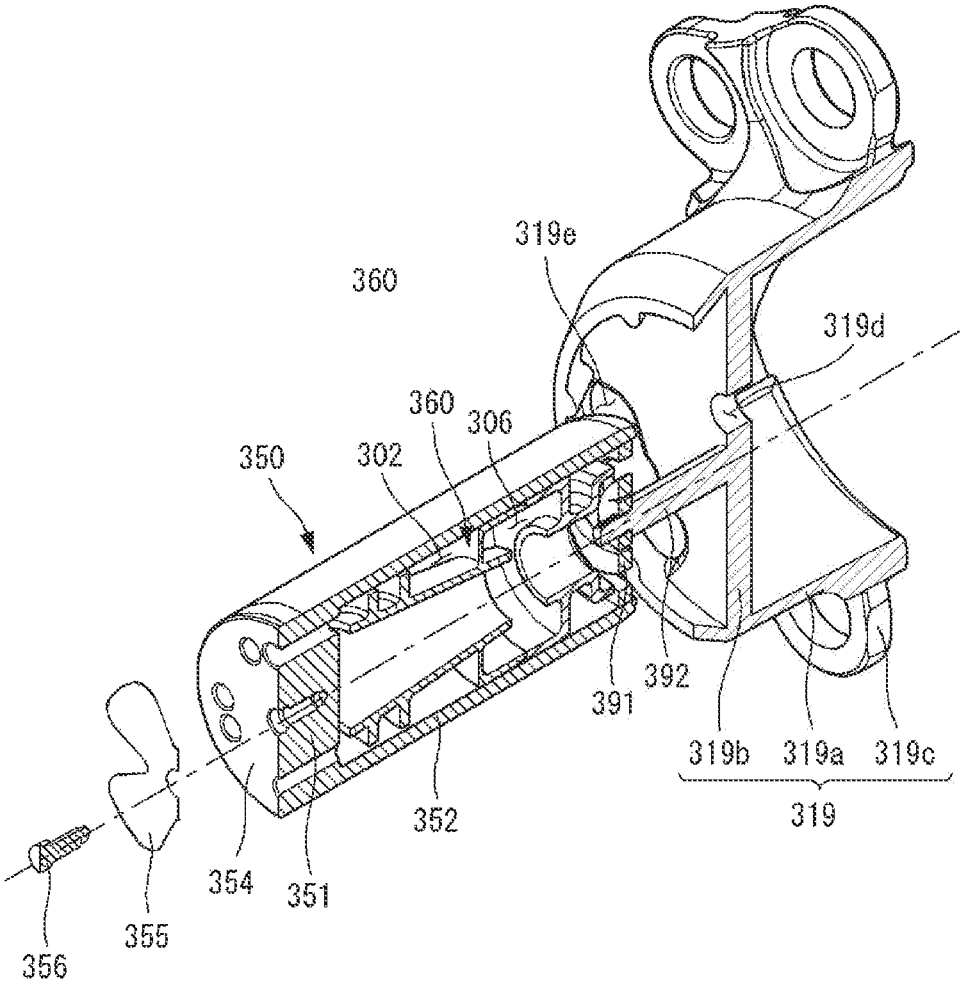
FIG. 10 is a cross-sectional perspective view of partial configuration of a linear compressor according to a third embodiment of the present disclosure.
Figure 11:
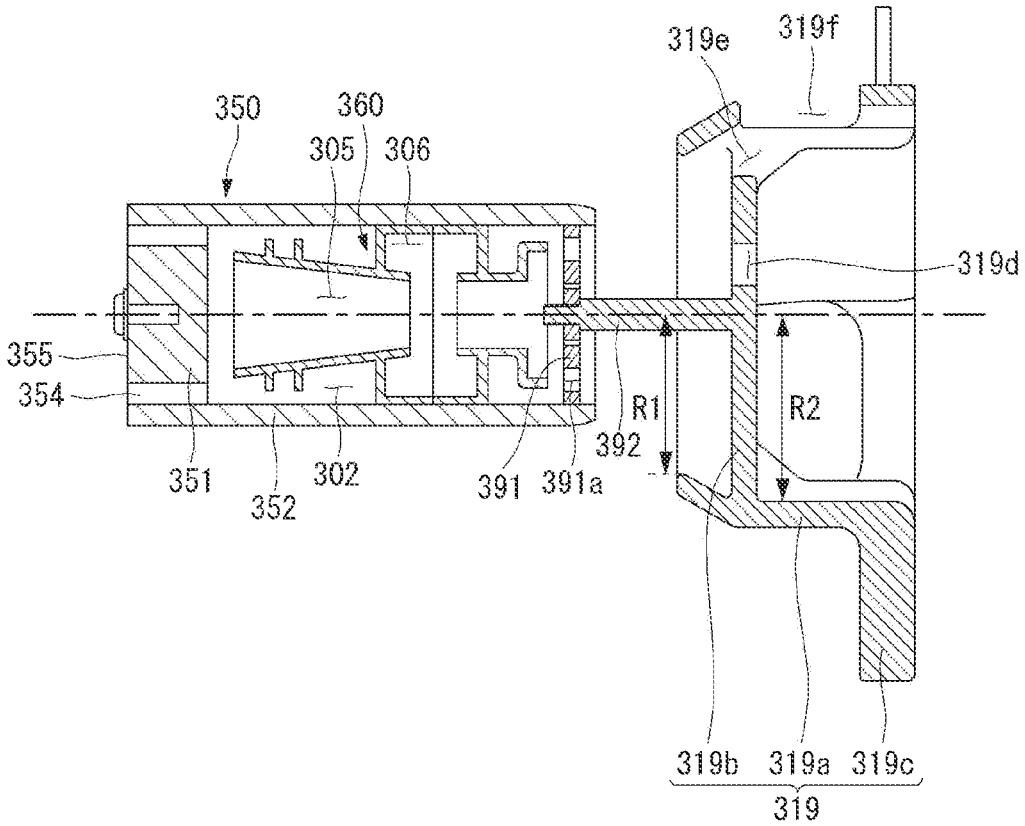
FIG. 11 is a cross-sectional view of partial configuration of a linear compressor according to a. third embodiment of the present disclosure.

FIG. 10 is a cross-sectional perspective view of partial configuration of a linear compressor 300 according to a third embodiment of the present disclosure. FIG. 11 is a cross-sectional view of partial configuration of the linear compressor 300 according to the third embodiment of the present disclosure.

It can be understood that detailed configuration of the linear compressor 300 according to the second embodiment of the present disclosure illustrated in FIGS. 10 and 11, in which the description is omitted later, is the same as detailed configuration of the linear compressor 100 according to the first embodiment of the present disclosure illustrated in FIGS. 2 to 7.

The linear compressor 300 may include an elastic body 391. The elastic body 391 may be disposed inside a piston 350. The elastic body 391 may be disposed adjacent to a rear end of a sliding portion 352. In this case, a method of coupling the elastic body 391 to an inner circumferential surface of the sliding portion 352 may be the same as described above with reference to FIG. 6. When the elastic body 391 is disposed adjacent to the rear end of the sliding portion 352, there is no need to seat the elastic body 391 to the depth of the piston 350. Therefore, a manufacturing process can be facilitated. In addition, a replacement operation of the elastic body 391 for maintenance can be facilitated.

The linear compressor 300 may include a muffler unit 360. The muffler unit 360 may be disposed in front of the elastic body 391. Since a rod 392 of the linear compressor 300 according to the third embodiment of the present disclosure is formed only up to a portion where the elastic body 391 is disposed, the rod 392 may not be formed inside an internal flow path 305 formed inside the muffler unit 360. In this case, since there is no part of the internal flow path 305 occupied by the rod 392, a refrigerant passing through a plurality of first flow holes 391*a* formed in the elastic body 391 can pass through the internal flow path 305 of the muffler unit 360 and can be smoothly introduced into an intake space 302.

As described above, the elastic body 391 may be coupled to various positions of the sliding portion 352. The tilting flexibility of the piston 350 may vary depending on the coupling position of the elastic body 391 and the sliding portion 352, and a rotation point of the piston 350 may vary. Accordingly, the present disclosure can adjust the coupling position of the elastic body 391 and can control the tilting flexibility and the rotation point of the piston 350.

Figure 12:
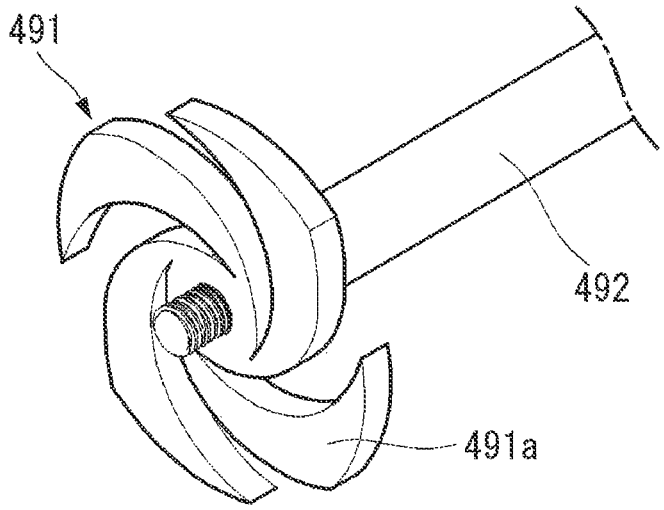
FIG. 12 is a perspective view illustrating one side of a rod and an elastic body of a linear compressor according to a fourth embodiment of the present disclosure.

FIG. 12 is a perspective view illustrating one side of a rod 492 of an elastic body 491 and the elastic body 491 in a linear compressor according to a fourth embodiment of the present disclosure.

It can be understood that detailed configuration of the linear compressor 400 according to the fourth embodiment of the present disclosure illustrated in FIG. 12, in which the description is omitted later, is the same as detailed configuration of the linear compressor 100 according to the first embodiment of the present disclosure illustrated in FIGS. 2 to 7.

The linear compressor 400 may include the elastic body 491. The elastic body 491 may be formed in a shape in which a plurality of elastic units 491*a* are radially disposed, and respective radially outer portions of the plurality of elastic units 491*a* are separated from each other. That is, when viewed axially, the elastic body 491 may be formed in a propeller shape.

Since the respective radially outer portions of the plurality of elastic units 491*a* are separated from each other, it may be easy to press-fit when inserted from the rear of a piston 450. Specifically, a radius of the elastic body 491 may be greater than a radius of a portion of an inner circumferential surface of a sliding portion 452 in which a groove 493 is not formed. In this instance, when the elastic body 491 is disposed in the rear of the piston 450 in a state in which the rod 492 is coupled to a radially central area of the elastic body 491, and then the elastic body 491 is press-fitted into the sliding portion 452 by pushing the rod 492, an outer portion of the elastic body 491 may be introduced into the inside of the sliding portion 452 while slightly bending rearward. When the elastic body 491 is press-fitted up to the position where the groove 493 is formed, the outer portion of the elastic body 491 may be seated in the groove 493, and the elastic body 491 may be fixed to the piston 450.

In order to ensure proper elasticity of the elastic body 491, each of the plurality of elastic units 491*a* may be formed in a spiral shape away from the axis. Alternatively, based on an internal structure of the piston 450, a coupling relationship between the piston 450 and the elastic body 491, and the like, the plurality of elastic units 491*a* may be formed in various shapes such as straight extending radially outward about the axis.

A refrigerant may flow into each space between the plurality of elastic units 491*a*. That is, it can be understood that each space between the plurality of elastic units 491*a* performs the same role as the first flow hole 191*a* of the linear compressor 100 according to the first embodiment of the present disclosure.

Figure 13:
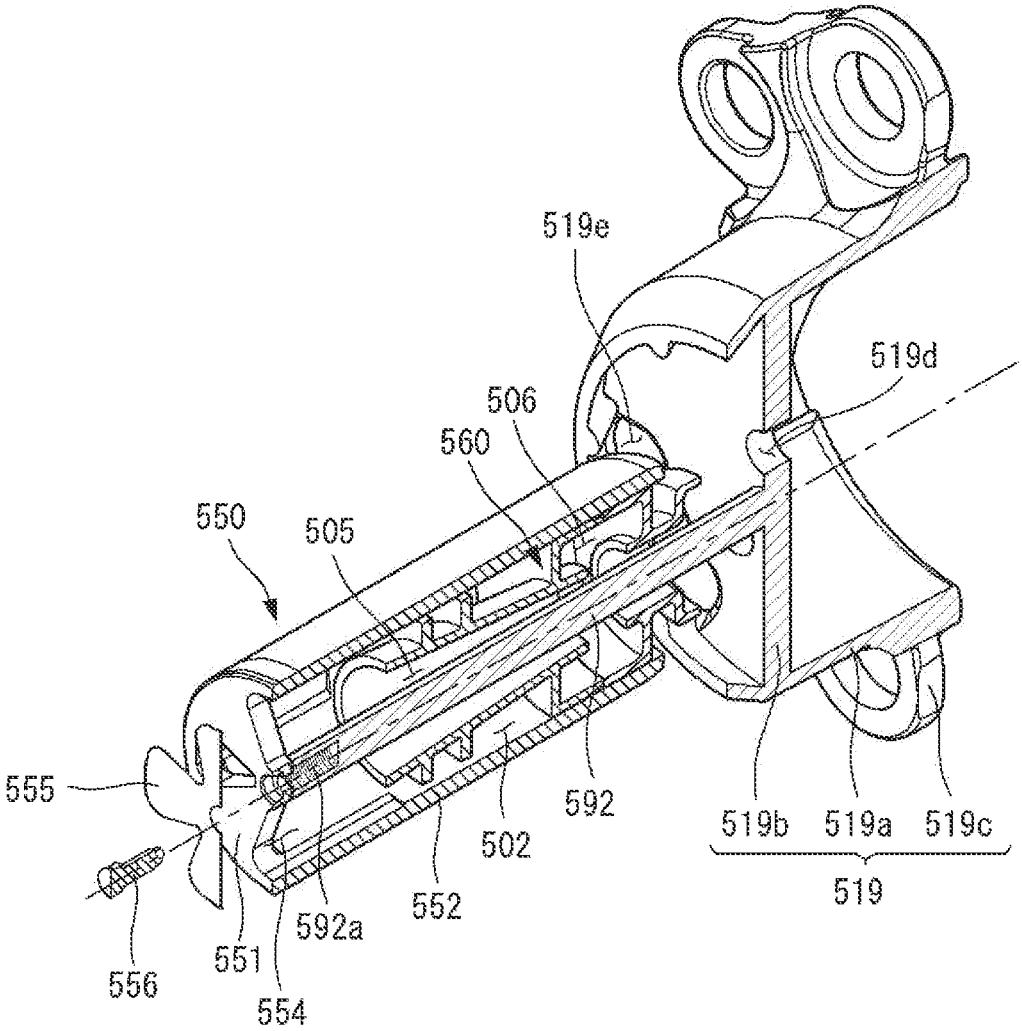
FIG. 13 is a cross-sectional perspective view of partial configuration of a linear compressor according to a fifth embodiment of the present disclosure.
Figure 14:
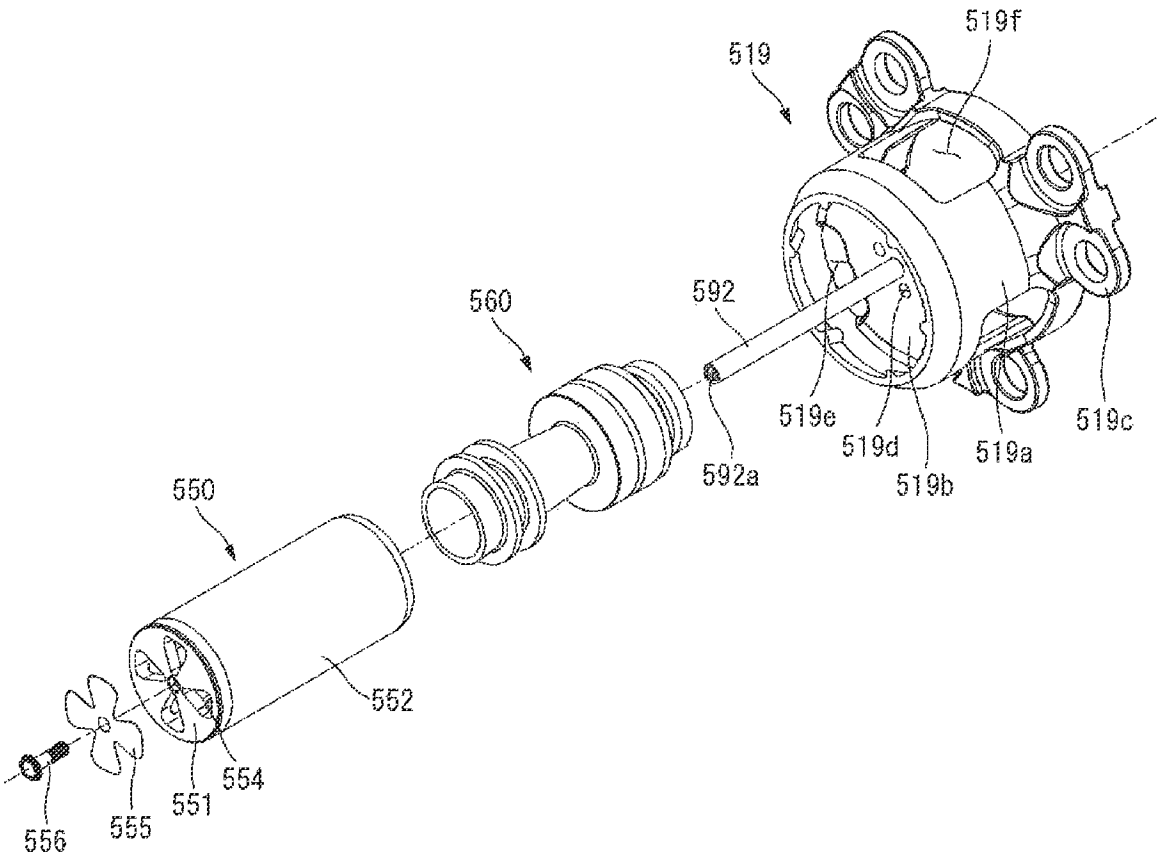
FIG. 14 is an exploded perspective view of partial configuration of a linear compressor according to a fifth embodiment of the present disclosure.
Figure 15:
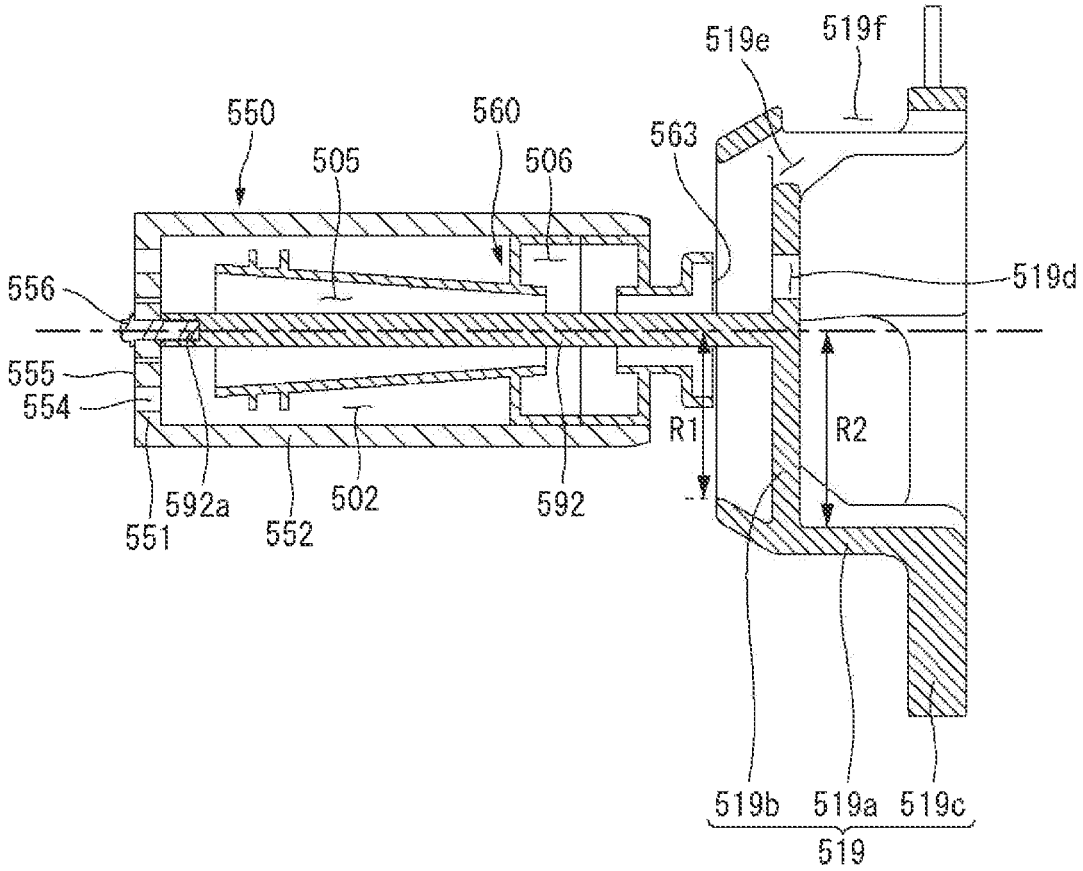
FIG. 15 is a cross-sectional view of partial configuration of a linear compressor according to a fifth embodiment of the present disclosure.

FIG. 13 is a cross-sectional perspective view of partial configuration of a linear compressor 500 according to a fifth embodiment of the present disclosure. FIG. 14 is an exploded perspective view of partial configuration of the linear compressor 500 according to the fifth embodiment of the present disclosure. FIG. 15 is a cross-sectional view of partial configuration of the linear compressor 500 according to the fifth embodiment of the present disclosure.

It can be understood that detailed configuration of the linear compressor 500 according to the fifth embodiment of the present disclosure illustrated in FIGS. 13 to 15, in which the description is omitted later, is the same as detailed configuration of the linear compressor 100 according to the first embodiment of the present disclosure illustrated in FIGS. 2 to 7.

The linear compressor 500 may include a piston 550. The piston 550 may include an elastic portion 551 and a sliding portion 552 extending rearward from a radially outer edge of the elastic portion 551. The piston 550 may be connected to a supporter 519 by a rod 592 to reciprocate axially inside a cylinder 540.

The linear compressor 500 may include the elastic portion 551. A radially central area of the elastic portion 551 may be coupled to one side of the rod 592. The piston 550 may be elastically supported axially and/or radially by the elastic portion 551 coupled to one side of the rod 592.

Referring to FIGS. 13 and 14, the elastic portion 551 may extend outward radially about an axis. The elastic portion 551 may be radially disposed and may be a leaf spring formed in a disk shape.

When the elastic portion 551 is formed of the leaf spring, radial elasticity may be stronger than axial elasticity. When the elastic portion 551 has the stronger radial elasticity than the axial elasticity, the eccentricity of the supporter 519 with respect to the elastic portion 551 can be minimized. When the axial elasticity of the elastic portion 551 is weak, flexible tilting may be possible.

Specifically, the supporter 519 may be elastically supported by a plurality of resonant springs 518 coupled to a spring seat portion 519*c*. The supporter 519 may be a mover that is coupled to a magnet frame 536, to which a magnet 535 is coupled, and reciprocates axially. In this case, the alignment between the axis of the linear compressor 500 and the axis of the supporter 519 may be misaligned. When the piston 550 is not flexibly tilted with respect to the supporter 519, the axial alignment of the piston 550 with respect to the cylinder 540 may also be misaligned. Therefore, a friction and/or contact may occur between the piston 550 and the cylinder 540. The friction may wear and damage the components.

When the elastic portion 551 is formed of the leaf spring, a tilting freedom of the piston 550 with respect to the supporter 519 may increase. Therefore, the piston 550 can easily maintain the axial alignment by the gas bearing on the inside of the cylinder 540. At the same time as this, since the eccentricity of the supporter 519 and/or the magnet frame 536 with respect to the piston 550 can be reduced, a gap in a drive unit 530 can be kept relatively constant. Through this, since the contact and/or friction between the components can be reduced, a damage of the component and noise generation can be prevented. Hence, the reliability of the linear compressor 500 can be improved, and the efficiency of the linear compressor 500 can also be improved.

The elastic portion 551 may include a plurality of fourth flow holes 554. The refrigerant may be introduced into a compression space 503 firmed in front of the piston 550 through the plurality of fourth flow holes 554. That is, it can be understood that the plurality of fourth flow holes 554 perform the same role as the intake port 154 of the linear compressor 100 according to the first embodiment of the present disclosure.

The refrigerant introduced into the compression space 503 through the plurality of fourth flow holes 554 may be compressed by a front surface of the elastic portion 551 and may be discharged to a discharge space 504. That is, it can be understood that the elastic portion 551 performs the same role as the elastic body 191 of the linear compressor 100 according to the first embodiment of the present disclosure and also performs the same role as the head portion 151 of the piston 150 of the linear compressor 100.

The plurality of fourth flow holes 554 may be disposed radially about the axis. Each of the plurality of fourth flow holes 554 may be formed in a spiral shape away from the axis. The plurality of fourth flow holes 554 may be formed in various shapes so as to secure the proper elasticity of the elastic portion 551. The plurality of fourth flow holes 554 may be understood as slits formed between elastic elements of the leaf spring. Accordingly, the elasticity of the elastic portion 551 may be controlled by adjusting the shape, the size, or the number of the plurality of fourth flow holes 554.

Alternatively, in order for an intake valve 555 to stably open and close elastically the plurality of fourth flow holes 554, each of the plurality of fourth flow holes 554 may be formed in a substantially fan shape.

Since the elastic portion 551 has to be elastically deformed unlike the head portion 151 of the linear compressor 100 according to the first embodiment of the present disclosure, an axial length of the elastic portion 551 may be less than an axial length of the head portion 151 of the linear compressor 100 according to the first embodiment of the present disclosure.

As described above, the linear compressor 500 according to the fifth embodiment of the present disclosure can reduce the manufacturing cost and simplify the manufacturing process since a front end of the piston 550 is formed of arm elastic material without the separate elastic body 191 for flexible tilting of the piston 550.

The linear compressor 500 may include the rod 592. The rod 592 may extend axially. The rod 592 may be disposed inside an internal flow path 505 extending axially inside a muffler unit 560. One end of the rod 592 may be coupled to the radially central area of the elastic portion 551, and other end may be coupled to a radially central area of a plate 519*b*. An elastic force of the resonant spring 518 may be transmitted to the rod 592 through the supporter 519. The elastic force transmitted to the rod 592 may be transmitted to the piston 550 through the elastic portion 551.

The linear compressor 500 may include the intake valve 555. The intake valve 555 may be coupled to the front of the elastic portion 551. The intake valve 555 may be configured to cover fronts of the plurality of fourth flow holes 554. The intake valve 555 may be formed to be slightly larger than the plurality of fourth flow holes 554.

For example, when each of the plurality of fourth flow holes 554 is formed in a spiral shape away from the axis, the intake valve 555 may extend to a position where the plurality of fourth flow holes 554 are formed. In this instance, the intake valve 555 may be configured such that a portion axially extended to cover all the plurality of fourth flow holes 554 is formed in a shape corresponding to the shape of the plurality of fourth flow holes 554 and is formed to be slightly larger than the plurality of fourth flow holes 554. That is, it may be understood that the intake valve 555 is formed in a shape similar to a fan blade when viewed axially.

The intake valve 555 may selectively open and close the plurality of fourth flow holes 554 formed in the elastic portion 551 forming one surface of the compression space 503. That is, the intake valve 555 may be elastically deformed to open the plurality of fourth flow holes 554 by a pressure of the refrigerant that passes through the plurality of fourth flow holes 554 and is introduced into the compression space 503.

The elastic portion 551 and the rod 592 may be rigidly coupled. When the rod 592 is formed of the rigid material and is rigidly coupled to the elastic portion 551, an elastically deformed portion is limited to the elastic portion 551. Therefore, a rotation point of the piston 550 can be easily designed. In addition, since the flexibility of the tilting of the piston 550 can be adjusted by forming the elastic portion 551 with the proper elasticity to a behavior of the piston 550, the behavior of the piston 550 can be easily controlled.

The linear compressor 500 may include a coupling member 556. The coupling member 556 may couple the intake valve 555 and the piston 550 to a front end of the rod 592. That is, the intake valve 555 may be coupled to the front surface of the elastic portion 551 by the coupling member 556, and the elastic portion 551 may be coupled to one side of the rod 592.

Specifically, the coupling member 556 may axially pass through a radially central area of the intake valve 555 and the radially central area of the elastic portion 551 and may be coupled to one side of the rod 592. The rod 592 may include a second coupling groove 592*a*. The second coupling groove 592*a* may be formed on one side of the rod 592. The second coupling groove 592*a* may be formed of a female screw. The coupling member 556 may be formed of a male screw. The coupling member 556 may be screw-coupled to the second coupling groove 592*a*.

As described above, since the intake valve 555 and the elastic portion 551 can be simultaneously coupled to one side of the rod 592 through one coupling member 556, the manufacturing process can be simplified, and the manufacturing cost can be reduced.

Alternatively, the elastic portion 551 and one side of the rod 592 may be integrally formed. When the elastic portion 551 and the rod 592 are integrally formed, the present disclosure can prevent the problem such as noise generation due to a gap that may occur at the coupling portion between the elastic body 191 and the rod 592.

Some embodiments or other embodiments of the present disclosure described above are not exclusive or distinct from each other. Some embodiments or other embodiments of the present disclosure described above can be used together or combined in configuration or function.

For example, configuration "A" described in an embodiment and/or the drawings and configuration "B" described in another embodiment and/or the drawings can be combined with each other. That is, even if the combination between the configurations is not directly described, the combination is possible except in cases where it is described that it is impossible to combine.

The above detailed description is merely an example and is not to be considered as limiting the present disclosure. The scope of the present disclosure should be determined by rational interpretation of the appended claims, and all variations within the equivalent scope of the present disclosure are included in the scope of the present disclosure.

The invention claimed is:

1. A linear compressor comprising:

a cylinder;

a piston configured to reciprocate inside the cylinder, the piston comprising a sliding portion and a head portion;

a supporter comprising a plate disposed at a side of the piston opposite to the head portion of the piston;

an elastic body disposed at the piston and having an outer side coupled to an inner circumferential surface of the piston; and a rod extending axially and having (i) a first side coupled to a central area of the elastic body and (ii) a second side connected to a central area of the plate, wherein the first side of the rod is formed of a male thread, wherein a coupling hole formed of a female thread is comprised in the central area of the elastic body, wherein the coupling hole is screw-coupled to the first side of the rod, wherein an outer circumferential surface of the elastic body is formed of a male thread, wherein a part of an inner circumferential surface of the piston to which the elastic body is coupled is formed of a female thread, wherein the elastic body is screw-coupled to the inner circumferential surface of the piston, and wherein the elastic body comprises a plurality of first flow holes disposed about an axis of the rod.

2. The linear compressor of claim 1, wherein the elastic body extends radially.

3. The linear compressor of claim 2, wherein the head portion comprises an intake port configured to receive refrigerant, wherein the intake port axially overlaps at least a part of the plurality of first flow holes, and wherein a total area of the plurality of first flow holes is greater than a total area of the intake port.

4. The linear compressor of claim 2, further comprising:

a muffler inserted into the piston at the side of the piston, wherein the muffler comprises an internal flow path extending axially, and wherein a total area of the plurality of first flow holes is greater than a smallest cross-sectional area of the internal flow path.

5. The linear compressor of claim 1, wherein the sliding portion defines a groove at an inner circumferential surface of the piston, and wherein the elastic body is coupled to the groove.

6. The linear compressor of claim 1, wherein the rod includes a rigid material.

7. The linear compressor of claim 2, wherein the plate defines a second flow hole at a first portion radially away from the rod, and wherein the second flow hole is defined at an inner area of an inner circumferential surface of the piston.

8. The linear compressor of claim 7, wherein the plate defines a third flow hole at a second portion that is radially outer than the first portion, wherein the supporter further comprises:

a body portion coupled to a circumference of the plate, and a spring seat portion extending radially from the body portion, wherein the body portion comprises a front portion protruding toward a front of the plate, and wherein an opening of the front portion of the body portion is smaller than the plate.

9. The linear compressor of claim 1, further comprising:
a muffler inserted into the piston at the side of the piston,
wherein the muffler is disposed at one of opposite sides of the elastic body.

10. The linear compressor of claim 1, further comprising:
a muffler disposed at the piston,
wherein the muffler comprises:
an internal flow path extending axially, and
a noise space defined at a part of the internal flow path, and
wherein the elastic body is disposed at a position that defines the noise space.

* * * * *